US012492636B2

(12) United States Patent
Chen et al.

(10) Patent No.: US 12,492,636 B2
(45) Date of Patent: Dec. 9, 2025

(54) INTERNAL AND EXTERNAL COUPLING SHEAR RESISTANCE LOCKING CONTROL SYSTEM AND MONITORING METHOD OF TUNNEL SURROUNDING ROCKS

(71) Applicant: China University of Mining & Technology—Beijing, Beijing (CN)

(72) Inventors: Dongdong Chen, Beijing (CN); Shuaishuai Yue, Beijing (CN); Shengrong Xie, Beijing (CN); Jun Zou, Beijing (CN); Wenzhe Gu, Beijing (CN); Yiquan Wu, Beijing (CN); Lei Zhu, Beijing (CN); Chunyang Tian, Beijing (CN); Sen Yang, Beijing (CN); Shikun Xing, Beijing (CN); Hao Pan, Beijing (CN)

(73) Assignee: China University of Mining & Technology—Beijing, Beijing (CN)

( * ) Notice: Subject to any disclaimer, the term of this patent is extended or adjusted under 35 U.S.C. 154(b) by 0 days.

(21) Appl. No.: 19/004,309

(22) Filed: Dec. 28, 2024

(65) Prior Publication Data

US 2025/0250899 A1 Aug. 7, 2025

(30) Foreign Application Priority Data

Feb. 1, 2024 (CN) ..... 202410142394.8

(51) Int. Cl.
*E21C 41/18* (2006.01)
*E21D 20/02* (2006.01)

(52) U.S. Cl.
CPC ..... *E21D 20/025* (2013.01); *E21C 41/18* (2013.01)

(58) Field of Classification Search
CPC ..... E21D 20/025; E21C 41/18
See application file for complete search history.

(56) References Cited

U.S. PATENT DOCUMENTS

2023/0340878 A1 10/2023 Weiyao et al.

FOREIGN PATENT DOCUMENTS

CN 111365077 B * 2/2021
CN 118168595 A * 6/2024

* cited by examiner

*Primary Examiner* — Amber R Anderson
*Assistant Examiner* — Stacy N Lawson
(74) *Attorney, Agent, or Firm* — Hawaii Patent Services; Nathaniel K. Fedde; Kenton N. Fedde

(57) ABSTRACT

An internal and external coupling shear resistance locking control system and monitoring method of tunnel surrounding rocks, comprises an internal shear resistance and monitoring system of tunnel surrounding rocks, an external shear resistance and monitoring system of tunnel surrounding rocks, a relative shear displacement monitoring system of the tunnel walls and the roof and floor layers, and an anchor agent installation system; holes are expanded in the anchor cable drilling holes passing through coal-rock interface areas of the coal walls and roof and floor rock layers to form shear misalignment tolerance cavities; monitoring pressure values of measuring bags and liquid discharge in the shear misalignment tolerance cavities to determine shear deformations of the shear misalignment tolerance cavities, monitoring forces on anchor cables, compensating pull rods and shear resistance steel strips, and adjusting the shear resistance of the anchor cable and steel belt through the compensation rod structure.

3 Claims, 16 Drawing Sheets

INTERNAL AND EXTERNAL COUPLING SHEAR RESISTANCE LOCKING CONTROL SYSTEM AND MONITORING METHOD OF TUNNEL SURROUNDING ROCKS

INCORPORATION BY REFERENCE

This application claims the benefit of priority from China Patent Application No. 2024101423948 filed on Feb. 1, 2024, the contents of which are hereby incorporated by reference in their entirety.

TECHNICAL FIELD

The present invention relates to the technical field of internal and external shear resistance control and monitoring of tunnel surrounding rocks, and in particular to an internal and external coupling shear resistance locking control system and monitoring method of tunnel surrounding rocks.

BACKGROUND TECHNOLOGY

Coal tunnels are easy to dig, with fast construction speed, and coal can be produced during digging. At the same time, with rapid development of strong anchor cable support technology, most of the tunnels in coal mines are currently arranged in coal seams, including mining tunnels, preparation tunnels and development tunnels. The mining depth of coal mines increases year by year, the mining intensity rises sharply, and phenomenon of large deformations of coal walls into tunnel spaces is very common.

When the coal body is soft and broken, the coal walls will move to the tunnel spaces in a large range as a whole. If the strong anchor cables are arranged in the coal body, the anchor failure is easy to occur due to the weak anchor foundation of the coal body, and even high-strength anchor cables are difficult to play an effective role. If grouting is performed on a large area of the coal walls, the effect is minimal when the coal body is soft, which affects the construction progress and greatly increases economic costs. At the same time, it increases costs and difficulty of coal cleaning.

The anchor cables are arranged obliquely to the tunnel walls, which can make anchoring sections of anchoring agents of the anchor cables in the roof or floor rock layers. The anchorability and stability of the rock layers are significantly greater than the anchorability and stability of the coal bodies, which gives the high-strength anchor cables a foundation to exert its high-strength support force. The advantages are very prominent, especially for soft and large-scale plasticized coal bodies. The anchor cables are arranged obliquely and penetrate the roof and floor rock layers, which plays a very important role in controlling the overall movement of the coal walls into the tunnel spaces. The anchor cables cross the tunnel walls diagonally and are anchored into the roof rock layers, which has outstanding advantages, especially the strong anchor control effect is significant and has a stable anchoring foundation. However, there will still be two types of shear problems, internal and external, which will significantly affect support effects:

(1) Internal effects: the anchor cables of the coal walls obliquely penetrate interfaces between the coal walls and the roof and floor rock layers; parameters of stress states of the coal walls, the roof and floor rock layers and the coal rock itself are quite different; overall outward deformations of the coal walls exceed the deformations of the roof and floor rock layers in coal-rock interface areas. Therefore, there will be obvious relative shear displacements between the coal walls and the roof and floor rock layers. In this way, the anchor cables passing through the coal seams and the roof and floor rock layers will generate strong shear forces. At this time, the anchor cables not only bear severe tensile forces but also severe shear forces, so the anchor cables are easy to break and fail due to combined tension-shear forces.

(2) External effects: the external effects are divided into four categories.

Firstly, when a single anchor cable is arranged obliquely on a tunnel wall, the single anchor cable is arranged on the surrounding rock wall of the tunnel wall; component force of support force of the anchor cable along the surrounding rock wall cannot be balanced by the single anchor cable itself, so the anchor cable body needs to squeeze wall of an orifice of an anchor cable drilling hole, which will not only damage a shallow section of the anchor cable drilling hole, but also cause the anchor cable to be affected by combined effects of squeezing and shearing, which is prone to shear fracture at the orifice of the drilling hole and a contact area between the anchor and a pallet.

Secondly, If two anchor cables arranged obliquely on the upper and lower sides of the tunnel walls are interconnected by ordinary steel strips or channel steels, the main process of the traditional anchor cable and steel strip or channel steel support is a transmission force mechanism in the drilling anchor section: surrounding rocks-anchoring agents-anchor cables-surrounding rock surfaces-steel strips or channel steels-pallets-anchors-anchor cable. It is difficult to actively balance the component forces of the oblique anchor cables along the surrounding rock wall simply by the steel strips or channel steels. Anchor cable channels on the steel strips or channel steels will shear the anchor cable bodies, and the anchor cable bodies will also tear the anchor cable channels on the steel strips or channel steels, so that bidirectional damages are caused. When deformations of the surrounding rock increases and stresses on the anchor cables increase sharply, the degree of mutual damages will significantly increase and even cause the support system to fail, greatly reducing support effects.

Thirdly, If the two anchor cable bodies arranged obliquely on the upper and lower sides of the tunnel walls are directly connected with each other for pre-tightening support, the anchor cable bodies will inevitably bend at orifices of the anchor cable drilling holes on the surrounding rock surfaces, and the bent anchor cables will inevitably strongly squeeze the orifices of the anchor cable drilling holes, which will lead to the breakage of the orifices and significantly reduce pre-tightening forces and supporting effects. At the same time, due to the bending of the anchor cables at the orifices, the anchor cables not only bear strong tensile forces but also bear strong shear forces given by the surrounding rocks of the orifices. Under a combined action of tension and shear, the anchor cables are easy to break and fail.

Fourthly, there is no systematic and targeted monitoring method for the two anchor cable bodies arranged obliquely on the upper and lower sides of the tunnel walls, so as to determine whether the anchor cables are affected by the shear forces in the orifices of the anchor cable drilling holes, and how much the shear forces are. There are also no targeted methods to eliminate or greatly reduce the influence of the shear forces based on monitoring results of the shear forces.

(3) Simultaneous internal and external effects: the anchor cable bodies arranged obliquely on the tunnel walls are subjected to shear forces inside the tunnel surrounding rocks and shear resistances outside the surrounding rocks at the same time. There is no targeted coupling method to eliminate or greatly reduce the internal and external shear forces.

In view of the overall movement of the coal walls into the tunnel spaces, there are no stable anchoring foundations in the coal walls and the large deformation of the coal body cannot be restricted. The anchor cables are anchored to the stable roof and floor rock zones, which will cause the anchor cables to be subjected to strong shear forces inside the surrounding rocks and strong shear forces outside the surrounding rocks caused by the non-equilibrium movements of the coal walls and the roof and floor. It is urgent to propose a new method to realize the anchoring of the anchor cables to stable anchoring foundations, and effectively solve the problem of shearing of the anchor cables inside the surrounding rocks and the shearing of the anchor cables outside the surrounding rocks, realize the internal and external coupling shear resistance locking control of the tunnel surrounding rocks, give full play to the support performance of the anchor cables, and control the overall large deformations of the coal walls.

SUMMARY OF THE INVENTION

A purpose of the present invention is to provide an internal and external coupling shear resistance locking control system and monitoring method of tunnel surrounding rocks, so as to solve the problem that shear motions of roof and floor layers of the tunnel caused by non-equilibrium deformations of tunnel walls and the roof and floor layers has a significant impact on the anchor cables and shear forces cause support performance of the anchor cables to decrease sharply, or even the anchor cables are sheared to failure.

To achieve the above-mentioned purpose, the present invention provides an internal and external coupling shear resistance locking control system of tunnel surrounding rocks, comprising an internal shear resistance and monitoring system of tunnel surrounding rocks, an external shear resistance and monitoring system of tunnel surrounding rocks, a relative shear displacement monitoring system of the tunnel walls and the roof and floor layers, and an anchor agent installation system of pushing anchor agents;

the internal shear resistance and monitoring system of tunnel surrounding rocks comprises a plurality of rows of shear misalignment tolerance cavities obliquely passing through coal seams of tunnel walls; the shear misalignment tolerance cavities pass through transition zones between the coal seams of the tunnel walls and the roof rock layers, or passing through the transition zones between the coal seams of the tunnel walls and the floor rock layers; both ends of the shear misalignment tolerance cavities are connected to anchor cable drilling holes; orifices of the anchor cable drilling holes are set at the tunnel walls; the shear misalignment tolerance cavities are installed with a shear misalignment partition monitoring system or filled with compressible elastic expansion materials; and the internal shear resistance and monitoring system of tunnel surrounding rocks also comprises an elastic expansion material filling system for filling compressible elastic expansion materials;

The external shear resistance and monitoring system of tunnel surrounding rocks comprises shear resistance pallet structures, shear resistance steel strips, compensating pull rod structures, dynamometers, pressure gauges, and extrusion gauges; the shear resistance pallet structures are arranged at the orifices of the anchor cable drilling holes; and the shear resistance pallet structures are connected to the tunnel walls through the shear resistance steel strips, and the shear pallet structures are connected to the compensating pull rod structures;

The relative shear displacement monitoring system of the tunnel walls and the roof and floor layers comprises a relative shear displacement monitoring system of the tunnel walls and roof layers and a relative shear displacement monitoring system of the tunnel walls and floor layers; and the relative shear displacement monitoring system of the tunnel walls and the roof layers and the relative shear displacement monitoring system of the tunnel walls and the floor layers both comprise shear displacement measuring ruler rod bodies; and the shear displacement measuring ruler rod bodies are set on surfaces of the roof rock layers or surfaces of the floor rock layers of the tunnel;

The anchor agent installation system comprises a guide system and push protection tubes for passing the anchor agents through the shear misalignment tolerant cavities;

Preferably, the elastic expansion material filling system comprises filling conduits for conveying the compressible elastic expansion materials; outlets of the filling conduits are located in the shear misalignment tolerance cavities; inlets of the filling conduits extend out of the anchor cable drilling holes and are located in the tunnel; and the filling conduits are connected to the anchor cables in the anchor cable drilling holes through elastic fixing belts.

Preferably, the shear misalignment partition monitoring system comprises shear misalignment extrusion partition measuring bags; the shear misalignment extrusion partition measuring bags are arranged in the shear misalignment tolerance cavities; the shear misalignment extrusion partition measuring bags comprises four symmetrical cavities and anchor channel holes for passing the anchor cables; constraint positioning belts are arranged at the anchor channel holes; each cavity is connected to independent conduits; inlets of the conduits extend out of the anchor cable drilling holes and are located in the tunnel; the conduits are connected to the anchor cables in the anchor cable drilling holes through elastic fixing belts; slots are arranged on the elastic fixing belts; the conduits are clamped in the slots; and pressure gauges and adjustable resistance flowmeters are arranged at an inlet of each conduit.

Preferably, upper and lower parts of the shear resistance steel strips are both provided with steel strip limit blocks; middle parts of the shear resistance steel strips are provided with long anchor holes, the shear resistance pallet structures comprise end shear resistant pallets, middle shear resistant pallets and middle pallets; end anchor holes and conduit channels for the conduits or the filling conduits to pass through are provided on end shear resistant pallet; middle anchor holes are provided on the middle shear resistant pallets; transition zones between lower bottom surfaces and side surfaces of the end shear resistant pallets and the middle shear resistant pallets are arc shear zones; and pallet limit blocks are provided on the end shear resistant pallets.

Preferably, the transfer pallets are arranged on the end shear resistant pallets; circular anchor holes for passage of the anchor cables and the conduit holes for passage of the conduits or the filling conduits are provided on the transfer pallets; coupling spherical recesses are provided on the circular anchor hole; the circular anchor holes are aligned with the end anchor holes; the transfer pallets are connected to the compensating pull rod structures.

Preferably, the compensating pull rod structures comprise middle compensating pull rods; long anchor hole are provided in middle portions of the middle compensating pull rods; the long anchor holes are aligned with middle anchor cable holes; both ends of the middle compensating pull rod are connected to the end compensating pull rods through two-way locking nuts; the end compensating pull rods are connected to the transfer pallets through threads or hooks; dynamometers for monitoring tensions of the middle compensating pull rods and the end compensating pull rods are provided on the compensating pull rod structures; pressure gauges for monitoring support extrusion pressures of the anchor cables vertically arranged on the tunnel walls are installed between the end shear resistance pallets and the transfer pallets; and extrusion gauges are installed on contact sides of the steel strip limit blocks and the end shear resistance pallets.

Preferably, ends of the shear misalignment measuring ruler rods are connected to the top rock layers or the floor rock layers through embedded positioning anchor bolts, and the other ends of the shear misalignment measuring ruler rods are connected to the top rock layers or the bottom rock layers through pressure-releasing anchor bolts with pressure-releasing springs; inner slide grooves are provided in the shear misalignment measuring ruler rods; slide rods are provided in the inner slide grooves; the slide rods are connected to the inner slide grooves through ball bearings; telescopic reference rods are connected to bottom end portions of the slide rods; and indicator needles are connected to the telescopic reference rods.

Preferably, the guide system comprises guide clamping covers; guide clamping tubes are arranged in inner sides of the guide clamping covers; the guide clamping tubes are embeddedly connected with the push protection tubes; the cover surfaces of the guide clamping covers are arc surfaces; a plurality of centering wings are provided on the cover surfaces of the guide clamping covers; unidirectional elastic clamping wings are provided on ends of the centering wings; the unidirectional elastic clamping wings comprises telescopic springs and clamping needles; ends of the clamping needles are hinged to the centering wings; the clamping needles are connected to the centering wings through the telescopic springs; top ends of the guide clamping covers are connected to guide double half balls through guide rods; and the guide double half balls are rotatably connected to the guide rods through rotating shafts.

The present invention also provides an internal and external coupling shear resistance locking monitoring method of tunnel surrounding rocks, comprising a first monitoring method using the shear misalignment extrusion partition measuring bags and a second monitoring method using compressible elastic expansion materials; and the first monitoring method comprises following steps:

Step 1: Carrying out the anchor cable drilling holes in middle portions of the tunnel and installing the anchor cables into the anchor cable drilling holes;

Step 2: Carrying out the anchor cable drilling holes on upper sides of the tunnel walls to designed depths, and using high-pressure hydraulic jet expansion or mechanical expansion equipment to expand the anchor cable drilling holes in the transition zones between the coal seams of the tunnel walls and the floor rock layers to form the shear misalignment tolerance cavities; and both ends of the shear misalignment tolerance cavities gradually narrows outwards;

Step 3: Carrying out the anchor cable drilling holes on the upper sides of the tunnel walls and installing the anchoring agents; connecting the anchoring agents in series to inner sides of the guide clamping covers; setting the guide clamping tubes and anchoring agents inside the push protection tubes; installing the guide rods and the guide double half balls; pushing the anchoring agents and the guide system to bottom portions of the anchor cable drilling holes through the push protection tubes, and then withdrawing the push protection tubes;

Step 4: Before installing the anchor cables when carrying out the anchor cable drilling holes on the upper sides of the tunnel walls, fixing the shear misalignment extrusion partition measuring bags on the anchor cables; fixing the guide rods with an elastic fixing belts; after installing the anchor cables to the bottom portions of the anchor cable drilling holes on the upper sides of the tunnel walls, the shear misalignment extrusion partition measuring bags are located in the shear misalignment tolerance cavities;

Step 5: Carrying out the anchor cable drilling holes on lower sides of the tunnel walls to designed depths, and using high-pressure hydraulic jet expansion or mechanical expansion equipment to expand the anchor cable drilling holes in the transition zones between the coal seams of the tunnel walls and the floor rock layers to form the shear misalignment tolerance cavities;

Step 6: Carrying out the anchor cable drilling holes on the lower sides of the tunnel walls and installing the anchoring agents; connecting the anchoring agents in series to inner sides of the guide clamping covers; setting the guide clamping tubes and anchoring agents inside the push protection tubes; installing the guide rods and the guide double half balls; pushing the anchoring agents and the guide system to bottom portions of the anchor cable drilling holes through the push protection tubes, and then withdrawing the push protection tubes;

Step 7: Before installing the anchor cables when carrying out the anchor cable drilling holes on the lower sides of the tunnel walls, fixing the shear misalignment extrusion partition measuring bags on the anchor cables; fixing the guide rods with elastic fixing belts; after installing the anchor cables to the bottom portions of the anchor cable drilling holes on the upper sides of the tunnel walls, the shear misalignment extrusion partition measuring bags are located in the shear misalignment tolerance cavities;

Step 8: At the orifices of the upper anchor cable drilling holes and the lower anchor cable drilling holes, installing the shear resistance steel strips, the extrusion gauges, the middle shear resistant pallets, the end shear resistance pallets, the pressure gauges, the transfer pallets, the anchors, the compensating pull rod structures, the dynamometers, the pressure gauges and the adjustable resistance flowmeters in sequence;

Step 9: After tightening the compensating pull rods through the two-way locking nuts to make exposed anchor cable bodies parallel to axes of the anchor cable drilling holes, applying preload forces to the anchor cables to designed values;

Step 10: Filling the shear misalignment extrusion partition measuring bags with liquid;

Step 11: Installing the monitoring system for the shear displacement between the tunnel walls and the top layers at the intersections of the tunnel walls and the top rock layers, and installing the monitoring system for the shear displacement between the tunnel walls and the floor layers at the intersections of the tunnel walls and the floor rock layers; and Step 12: Monitoring pressure values of the pressure gauges of the shear misalignment extrusion partition measuring bags and liquid discharge volumes of the adjustable resistance flowmeters, and determining shear and extrusion deformations of the shear misalignment tolerance cavities inside the surrounding rocks; monitoring changes in values of the pressure gauges of the anchor cables, changes in values of the dynamometers of the compensating pull rods, changes in numerical values of the extrusion gauges of the steel strip limit blocks, the shear displacement of the roof and floor layers relative to the coal walls, comprehensively evaluating the relative displacement of the tunnel walls and the roof rock layers and floor rock layers, and actively adjusting tension values of the compensating pull rods to significantly reduce values of the extrusion gauges or to zero.

Preferably, the second monitoring method comprises following steps:

Step 1: Carrying out the anchor cable drilling holes in middle portions of the tunnel and installing the anchor cables into the anchor cable drilling holes;

Step 2: Carrying out the anchor cable drilling holes on upper sides of the tunnel walls to designed depths, and using high-pressure hydraulic jet expansion or mechanical expansion equipment to expand the anchor cable drilling holes in the transition zones between the coal seams of the tunnel walls and the floor rock layers to form the shear misalignment tolerance cavities; and both ends of the shear misalignment tolerance cavities gradually narrows outwards;

Step 3: Carrying out the anchor cable drilling holes on the upper sides of the tunnel walls and installing the anchoring agents; connecting the anchoring agents in series to inner sides of the guide clamping covers; setting the guide clamping tubes and anchoring agents inside the push protection tubes; installing the guide rods and the guide double half balls; pushing the anchoring agents and the guide system to bottom portions of the anchor cable drilling holes through the push protection tubes, and then withdrawing the push protection tubes;

Step 4: Before installing the anchor cables when carrying out the anchor cable drilling holes on the upper sides of the tunnel walls, fixing the filling conduits to the anchor cable bodies through the elastic fixing belts; the outlets of the filling conduits are in the shear misalignment tolerance cavities; after installing the anchor cables are installed, filling the compressible elastic expansion materials into the shear misalignment tolerance cavities through the filling conduits.

Step 5: Carrying out the anchor cable drilling holes on lower sides of the tunnel walls to designed depths, and using high-pressure hydraulic jet expansion or mechanical expansion equipment to expand the anchor cable drilling holes in the transition zones between the coal seams of the tunnel walls and the floor rock layers to form the shear misalignment tolerance cavities;

Step 6: Carrying out the anchor cable drilling holes on the lower sides of the tunnel walls and installing the anchoring agents; connecting the anchoring agents in series to inner sides of the guide clamping covers; setting the guide clamping tubes and anchoring agents inside the push protection tubes; installing the guide rods and the guide double half balls; pushing the anchoring agents and the guide system to bottom portions of the anchor cable drilling holes through the push protection tubes, and then withdrawing the push protection tubes;

Step 7: Before installing the anchor cables when carrying out the anchor cable drilling holes on the lower sides of the tunnel walls, fixing the filling conduits to the anchor cable bodies through the elastic fixing belts; the outlets of the filling conduits are in the shear misalignment tolerance cavities; after installing the anchor cables are installed, filling the compressible elastic expansion materials into the shear misalignment tolerance cavities through the filling conduits;

Step 8: At the orifices of the upper anchor cable drilling holes and the lower anchor cable drilling holes, installing the shear resistance steel strips, the extrusion gauges, the middle shear resistant pallets, the end shear resistance pallets, the pressure gauges, the transfer pallets, the anchors, the compensating pull rod structures, the dynamometers, the pressure gauges and the adjustable resistance flowmeters in sequence;

Step 9: After tightening the compensating pull rods through the two-way locking nuts to make exposed anchor cable bodies parallel to axes of the anchor cable drilling holes, applying preload forces to the anchor cables to designed values;

Step 10: Filling the shear misalignment extrusion partition measuring bags with liquid;

Step 11: Monitoring changes in values of the pressure gauges of the anchor cables, changes in values of the dynamometers of the compensating pull rods, changes in numerical values of the extrusion gauges of the steel strip limit blocks, the shear displacement of the roof and floor layers relative to the coal walls, comprehensively evaluating the relative displacement of the tunnel walls and the roof and floor layers, and actively adjusting tension values of the compensating pull rods to significantly reduce values of the extrusion gauges or to zero.

The present invention has following beneficial effects:

1. The present invention realizes the shear resistance of the anchor cables inside the surrounding rocks of the tunnel. Strong support cannot completely solve the shear deformation problem caused by the inevitable unbalanced displacement in coal-rock interface areas of the tunnel with large deformation, and support strength of the anchor cable bodies cannot be increased infinitely. In the present invention, holes are expanded in areas where the anchor cable drilling holes pass through the coal-rock interface areas to form the shear misalignment tolerance cavities; in this way, when unbalanced shear displacement of coal and rock layers occurs, the anchor cable bodies inside the surrounding rocks will not be affected by the shear forces; the present fundamentally and effectively solves the problem of anchor cable shearing caused by the unbalanced displacement of coal and rock layers in the coal-rock interface areas inside the surrounding rocks of the tunnel, and avoids breaking and failure of the anchor cables due to combined tension and shear forces in the coal-rock interface areas inside the surrounding rocks.

2. The present invention realizes the shear resistance of the anchor cables outside the tunnel surrounding rocks. As for the tunnel with large deformation, if the anchor cables are only anchored in the coal bodies of the tunnel walls, the coal bodies of the tunnel walls will be plasticized in a large range, and it is difficult to have a stable anchoring foundation, so it is difficult for the anchor cables to control the large deformation of the coal bodies of the tunnel walls. Therefore, the anchor cables on the upper sides of the tunnel walls can be anchored in the stable roof rock layers by tilting up the anchor cables at a certain angle; the anchor cables are arranged obliquely to the tunnel walls, and component forces of the anchor cables along the tunnel side walls causes ends of the anchor cables to move toward the roof; in this way, firstly, the anchor cables will be sheared by the steel strips; secondly, the anchor cable bodies and the orifices of the anchor cable drilling holes will be squeezed and sheared; thirdly, because of the universal anchors, although shear effects between the anchor cables, the anchors and the pallets can be alleviated to a certain extent, it is impossible to avoid the shear effects between the anchor cable bodies and the steel strips caused by the component forces of the anchor cables along the side walls of the tunnel, and the squeezing and shearing effects between the anchor cable bodies and the anchor cable drilling holes; by using the shear resistance steel strips, the shear resistance pallets and the transfer pallets, the present invention effectively solves the problem that the anchor cables outside the surrounding rocks of the tunnel are squeezed and sheared with the steel strips, the pallets and the anchor cable drilling holes.

3. The present invention realizes the internal and external coupling shear resistance locking control of the tunnel surrounding rocks. Since anchoring sections of the anchor cables are in the roof and floor rock layers of the tunnel, when the anchor cables drilling holes pass through the coal walls and the interface areas between the roof and the floor rock layers, the anchor cables drilling holes are all expanded to form the shear misalignment tolerance cavities, thereby realizing shear resistance effects of the roof layers, the coal walls and the floor layers of the tunnel surrounding rocks; the upper and lower anchor cables of the tunnel surrounding rock walls of the present invention achieve the purpose of the shear resistance of the anchor cables outside the surrounding rocks by coupling the shear resistance steel strips, shear resistance pallets and transfer pallets, and finally realize the coupling of the shear resistance system of the roof layers, the coal walls and the floor layers inside the tunnel surrounding rocks and the anchor cable shear resistance system outside the tunnel surrounding rocks, realizing the internal and external coupling shear resistance locking control system of the tunnel surrounding rocks, and effectively solving the problem of continuous large deformation of the coal walls without the stable anchoring foundation.

4. The present invention realizes active monitoring and regulation of the internal and external coupling locking shear resistance of the tunnel surrounding rocks. The shear misalignment tolerance cavities in the transition zones between the coal walls and the roof and floor layers can pass through the shear misalignment extrusion partition measuring bags and the shear misalignment extrusion partition measuring bags can not only test but also regulate extrusion shear error amount and pressure values of the shear misalignment tolerance cavities to a certain extent; the dynamometers are installed on the compensating pull rods, so it can be determined whether it is necessary to actively regulate the two-way locking nuts to adjust the tension of the compensating pull rods according to monitored values, so as to further balance the component forces of the anchor cables along the surrounding rock tunnel walls, and prevent the extrusion shear error between the anchor cables, the steel strips and the orifices of the drilling holes.

5. The present invention breaks the limitations of installation methods of traditional anchoring agents. By using the anchor agent installation system that passes through the shear misalignment tolerance cavities, the anchor agents can be smoothly installed even under conditions of the internal shear misalignment tolerance cavities, and the anchor agents can be smoothly installed under similar other conditions.

6. The present invention has important and extensive popularization significance, and is applicable to situations where shearing deformation occurs due to unbalanced movement between similar rock layers, resulting in shearing forces on the anchor cables. The technical solutions of the present invention are further described in detail below through the attached drawings and embodiments.

DESCRIPTION OF REFERENCE NUMERALS

Figure 1:
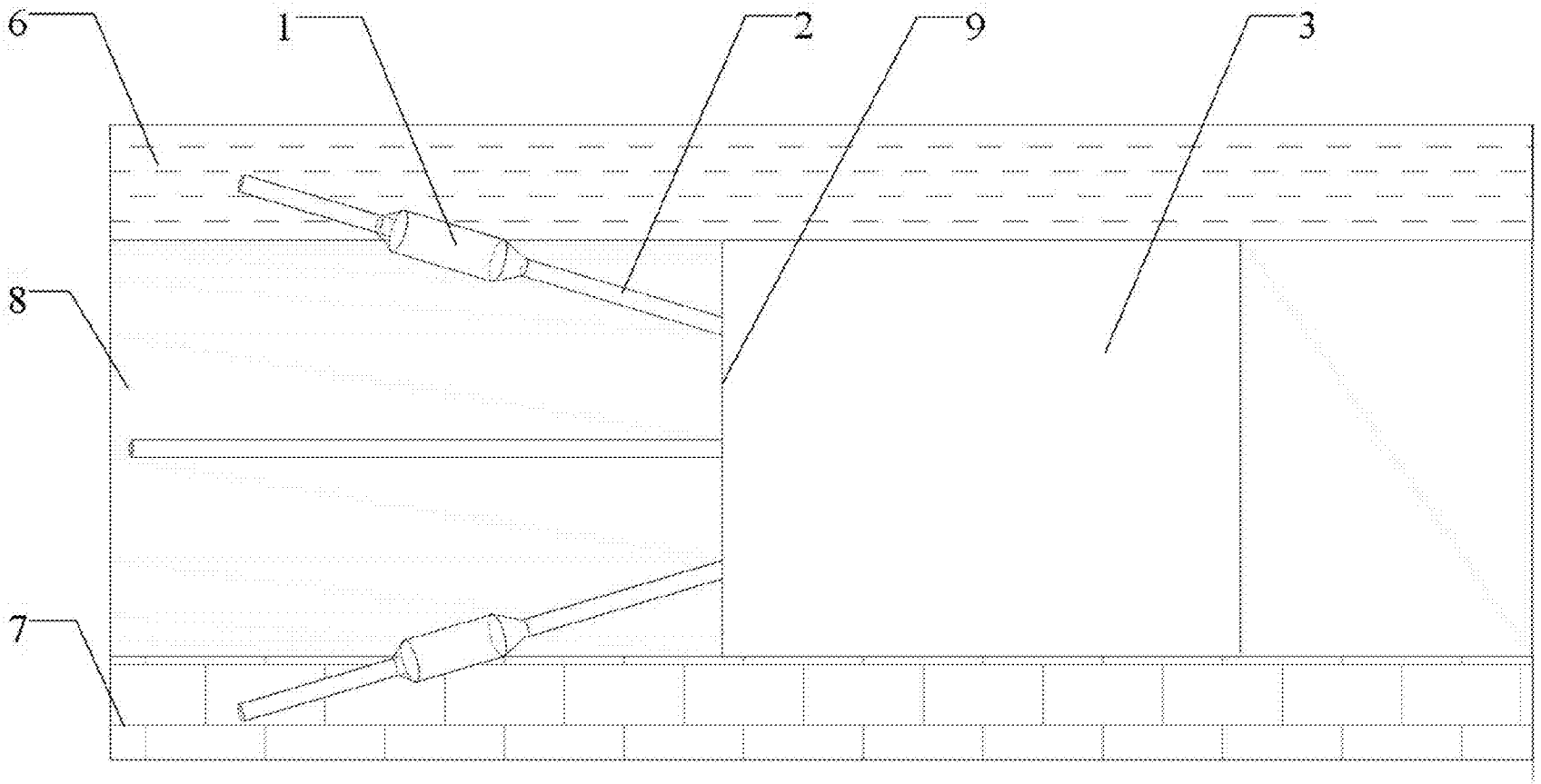
FIG. 1 is a schematic diagram of shear misalignment tolerance cavities according to embodiments of the present invention.

1, shear misalignment tolerance cavities; 2, anchor cable drilling holes; 3, tunnel; 4, anchor cable; 5, anchor; 6, top rock layer; 7, floor rock layer; 8, coal seam; 9, tunnel wall; 10, shear misalignment extrusion partition measuring bags; 11, conduit; 12, connector; 13, anchor channel hole; 14, constraint positioning belts; 15, elastic fixing belt; 16, slot; 17, end shear resistance pallet; 18, middle shear resistance pallet; 19, end anchor hole; 20, middle anchor holes; 21, pallet limit block; 22, arc shear resistance zone; 23, shear resistance steel strips; 24, steel strip limit block; 25, long anchor cable holes; 26, transfer pallet; 27, circular anchor hole; 28, conduit hole; 29, coupling spherical recess; 30, middle compensating pull rod; 31, two-way locking nut; 32, end compensating pull rod; 33, shear misalignment measuring ruler rod; 34, embedded positioning anchor bolt; 35, pressure-releasing spring; 36, pressure-releasing anchor bolt; 37, slide rod; 38, indicator needle; 39, telescopic reference rod; 40, ball bearing; 41, push protection tube; 42, guide clamping cover; 43, guide rod; 44, guide double half ball; 45, rotating shaft; 46, clamping tube; 47, centering wing; 48, one-way elastic clamping wing; 49, telescopic spring; 50, clamping needle; 51, anchor agent; 52, compensating pull rod structure; 53, adjustable resistance flowmeter; 54, pressure gauge; 55, filling conduit; 56, conduit channel; 57, long anchor hole; 58, dynamometer; 59, pressure gauge; 60, extrusion gauge; and 61, elastic expansion material.

EMBODIMENTS

In order to make the disclosed purpose, technical solutions and advantages of the embodiments of the present invention more clear, the embodiments of the present invention will be further described in detail with the attached drawings and embodiments. It should be understood that the specific embodiments described here are only used to explain the embodiments of the present invention, and are not used to limit the embodiments of the present invention. Based on the embodiments in the present application, all other embodiments obtained by those of ordinary skill in the art without creative work belong to the protective scope in the present application. Examples of the embodiments are illustrated in the attached drawings, in which the same or similar reference numerals indicate the same or similar elements or elements having the same or similar functions throughout.

It should be noted that the terms "comprising" and "having" and any variations thereof are intended to cover non-exclusive inclusion, for example, processes, methods, systems, products, or servers comprising a series of steps or units are not necessarily limited to comprising those steps or units explicitly listed, but may comprise other steps or units not explicitly listed or inherent to these processes, methods, products, or devices.

Similar reference numerals and letters denote similar items in the attached drawings, and therefore, once an item is defined in one drawing, further definition and explanation thereof is not required in subsequent drawings.

In the description of the present invention, it should be noted that the terms "upper", "lower", "inside", "outside", etc. indicate directions or positional relationships based on the directions or positional relationships shown in the attached drawings, or are directions or positional relationships in which the inventive product is usually placed when in use. They are only for the convenience of describing the present invention and simplifying the description, and do not indicate or imply that the devices or elements referred to must have specific directions, be constructed and operated in specific directions, and therefore should not be understood as limitations on the present invention.

in the description of the present invention, it is also necessary to explain that, unless otherwise clearly specified and limited, the terms "arranged", "installed", and "connected" should be understood in a broad sense, for example, it can be a fixed connection, a detachable connection, or an integral connection; it can be a mechanical connection or an electrical connection; it can be a direct connection, or it can be an indirect connection through an intermediate medium, or it can be the internal communication of two components. For those of ordinary skill in the art, the specific meanings of the above terms in the present invention can be understood according to specific circumstances.

Embodiment 1

The internal and external coupling shear resistance locking control system of tunnel 3 surrounding rocks in the present invention comprises an internal shear resistance and monitoring system of tunnel surrounding rocks and, an external shear resistance and monitoring system of tunnel surrounding rocks, a relative shear displacement monitoring system of the tunnel walls 9 and the roof and floor layers, and an anchor agent 51 installation system that can pass through the shear misalignment tolerance cavities 1;

The internal shear resistance and monitoring system of tunnel surrounding rocks comprises a plurality of rows of shear misalignment tolerance cavities 1 obliquely passing through coal seams 8 of tunnel walls 9; a shear misalignment partition monitoring system inside the tunnel 3 surrounding rocks, and a compressible elastic expansion material filling system; as shown in FIG. 1, the shear misalignment tolerance cavities 1 are located in the anchor cable drilling holes 2 that obliquely passes through the rock transition zones between coal bodies of the tunnel 3 walls and the roof or floor layers; high-pressure hydraulic jet expansion equipment or mechanical tool equipment is used to expand holes; the expansion diameter should be 10-20 cm, and the expansion length should be 20-50 cm; bottom portions of the shear misalignment tolerance cavities 1 (far away from the tunnel walls 9) adopts a method of gradually narrowing hole expansions and gradually transitions to a same hole diameter of the anchor cable drilling holes 2, so that the anchoring agents 51 and the anchor cables 4 can be installed to reach bottom portions of the anchor cable drilling holes 2; outer portions of the shear misalignment tolerance cavities 1 are also transitioned to the anchor cable drilling holes 2 with the same hole diameter in the method of gradually narrowing hole expansions; the outer portions of the shear misalignment tolerance cavities 1 (close to the tunnel walls 9)) adopts the method of gradually narrowing hole expansions, so that slag discharge is convenient; It is necessary to implement multiple rows of the shear misalignment tolerance cavities 1 in the same tunnel 3, and the formed shear misalignment tolerance cavities 1 are used in the following ways: firstly, all shear misalignment tolerance cavities 1 are installed with the shear misalignment partition monitoring system; secondly, the internal shear misalignment partition monitoring system is implemented at intervals of the anchor cables 4; other shear misalignment tolerance cavities 1 are not installed with the internal shear misalignment partition monitoring system, but filled with compressible elastic expansion materials 61 through the elastic expansion material filling system. The compressible elastic expansion materials 61 seals the shear misalignment tolerance cavities 1 and prevents moisture in the shear misalignment tolerance cavities 1 from corroding the anchor cables 4. When the coal seams and rock layers are sheared and deformed, the compressible elastic expansion materials 61 are easily compressible, therefore will not bring additional shear burden to the anchor cables 4.

The elastic expansion material filling system comprises filling conduits 55 and elastic fixing belts 15 for fixing the filling conduits 55; the filling conduits 55 are connected with the anchor cables 4 in the anchor cable drilling holes 2 through the elastic fixing belts 15; outlets of the filling conduits 55 are located in the shear misalignment tolerance cavities 1; after the anchor cables 4 are installed, the compressible elastic expansion materials 61 are filled into the shear misalignment tolerance cavities 1 through the filling conduits 55 to fill the whole shear misalignment tolerance cavities 1.

Figure 4:
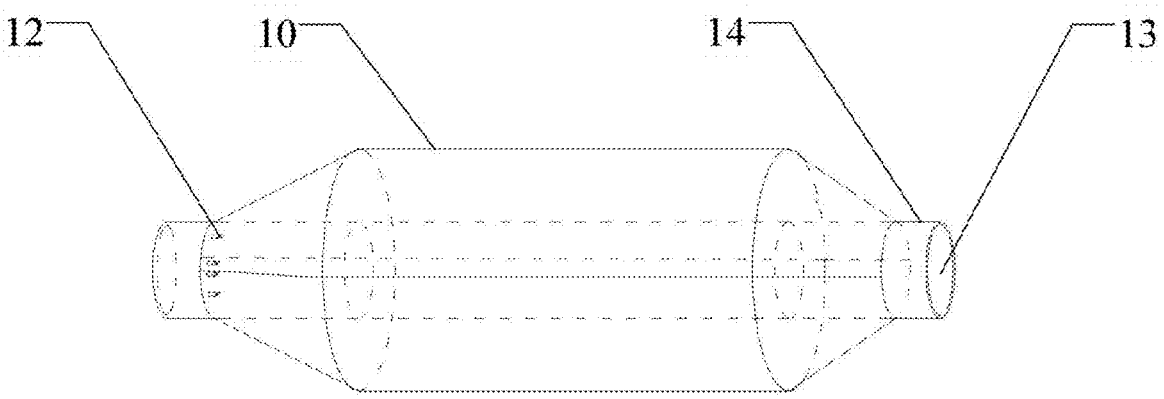
FIG. 4 is a schematic structural diagram of shear misalignment extrusion partition measuring bags according to the embodiments of the present invention.
Figure 5:
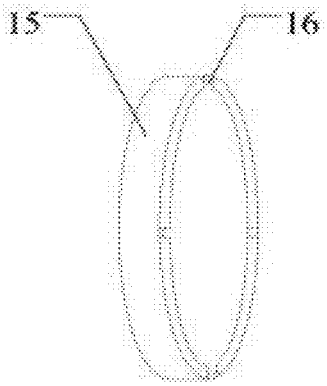
FIG. 5 is a schematic structural diagram of the elastic fixing belts according to the embodiments of the present invention.

The internal shear misalignment partition monitoring system comprises shear misalignment extrusion partition measuring bags 10, conduits 11, adjustable resistance flowmeters 53, elastic fixing belts 15 and pressure gauges 54. As shown in FIG. 4, the shear misalignment extrusion partition measuring bags 10 are composed of four symmetrical cavities; each cavity is provided with at least one independent conduit 11 and at least one anchor channel hole 13 for the anchor cables 4 to pass through; the anchor channel holes 13 are provided with constraint positioning belts 14; the four cavities are respectively connected with independent conduits 11 through separate connecters 12, and an inlet of each conduit 11 is provided with at least one pressure gauge 54 and at least one adjustable resistance flowmeter 53, so that the partition extrusion and shearing misalignment of the shear misalignment tolerance cavities 1 can be determined independently. As shown in FIG. 5, the conduits 11 are fixed to the anchor cables 4 through the elastic fixing belts 15, and the conduits 11 are clamped into the slots 16 of the elastic fixing belts 15, so that the shear misalignment extrusion partition measuring bags 10 are required to be in the whole shear misalignment tolerance cavities 11 after the anchor cables 4 are installed. The shear misalignment extrusion partition measuring bags 10 are filled with liquid, and the shear misalignment extrusion partition measuring bags 10 filled with liquid can fill the shear misalignment tolerance cavities 1.

Figure 15:
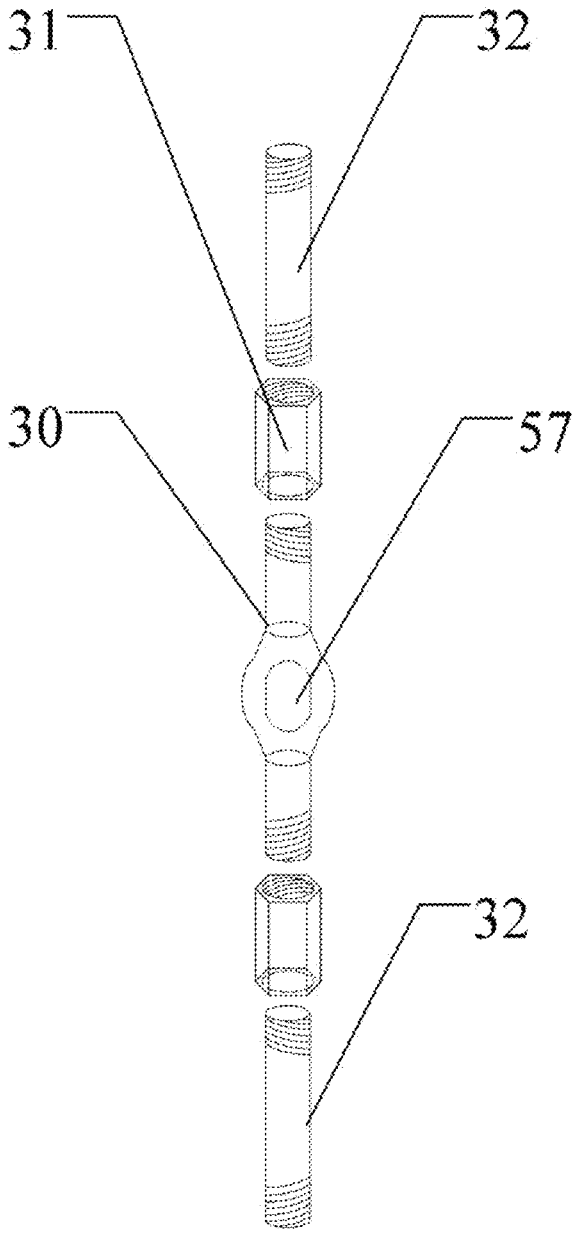
FIG. 15 is a schematic structural diagram of the bolt-connected compensating pull rods according to the embodiments of the present invention.
Figure 16:
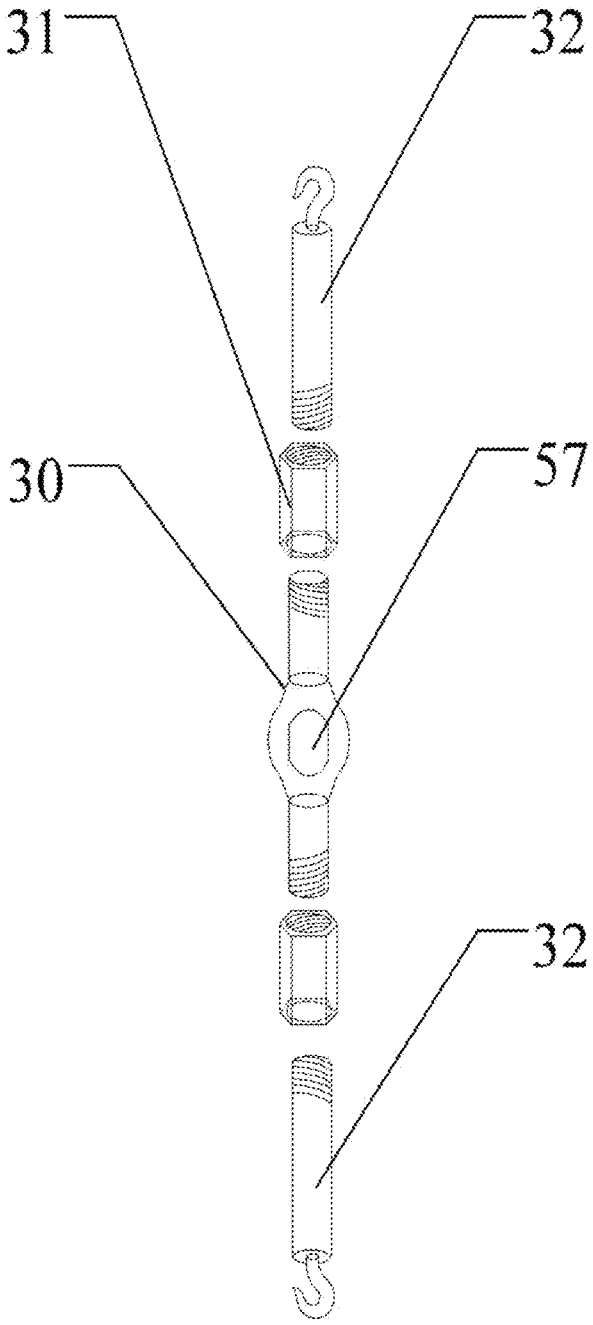
FIG. 16 is a schematic structural diagram of the hook-connected compensating pull rods according to the embodiments of the present invention.

The external shear resistance and monitoring system of tunnel surrounding rocks comprise shear resistance pallet structure; shear resistance pallet structure are arranged at orifice of the anchor cable drilling holes 2, and are connected to the tunnel walls 9 through shear resistance steel strips 23, and are connected to the compensating pull rod structures 52. The shear resistance pallet structures comprise end shear resistance pallets 17, middle shear resistance pallets 18, and transfer pallets 26; and the transfer pallets 26 are arranged on the end shear resistance pallets 17. As shown in FIGS. 15 and 16, the compensating pull rod structures 52 comprise middle compensating pull rods 30; long anchor holes 57 are arranged in the middle of the middle compensating pull rods 30; two ends of the middle compensating pull rods 30 are connected to the end compensating pull rods 32 through two-way locking nuts 31; and the end compensating pull rods 32 are connected to the transfer pallets 26 through threads or a hooks.

From the tunnel walls 9 to space of the tunnel 3, the shear resistance steel strips 23, the end shear resistance pallets 17, the middle shear resistance pallets 18, the transfer pallets 26, the middle compensating pull rods 30, the two-way locking nuts 31, the end compensating pull rods 32, anchors 5, anchor cables 4, dynamometers 58, pressure gauges 59 and extrusion gauges 60 are coupled to form the external shear resistance and the monitoring system of tunnel surrounding rocks; and the external shear resistance and the monitoring system of tunnel surrounding rocks and the internal shear resistance and the monitoring system of tunnel surrounding rocks jointly realize the internal and external coupling shear resistance locking control of tunnel 3 surrounding rocks.

Figure 6:
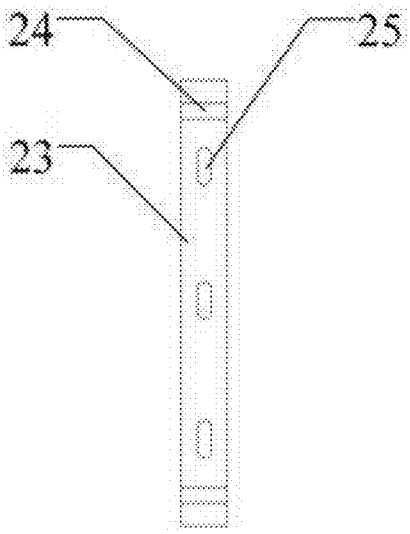
FIG. 6 is a front view of the shear steel belts according to the embodiments of the present invention.
Figure 7:
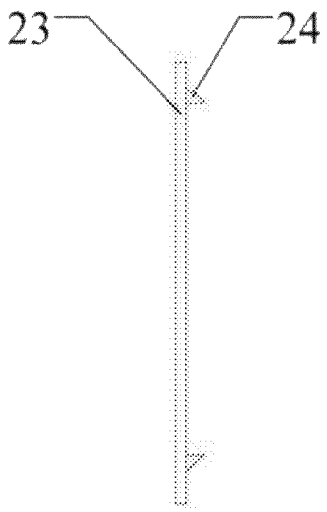
FIG. 7 is a side view of the shear steel belt according to the embodiments of the present invention.
Figure 8:
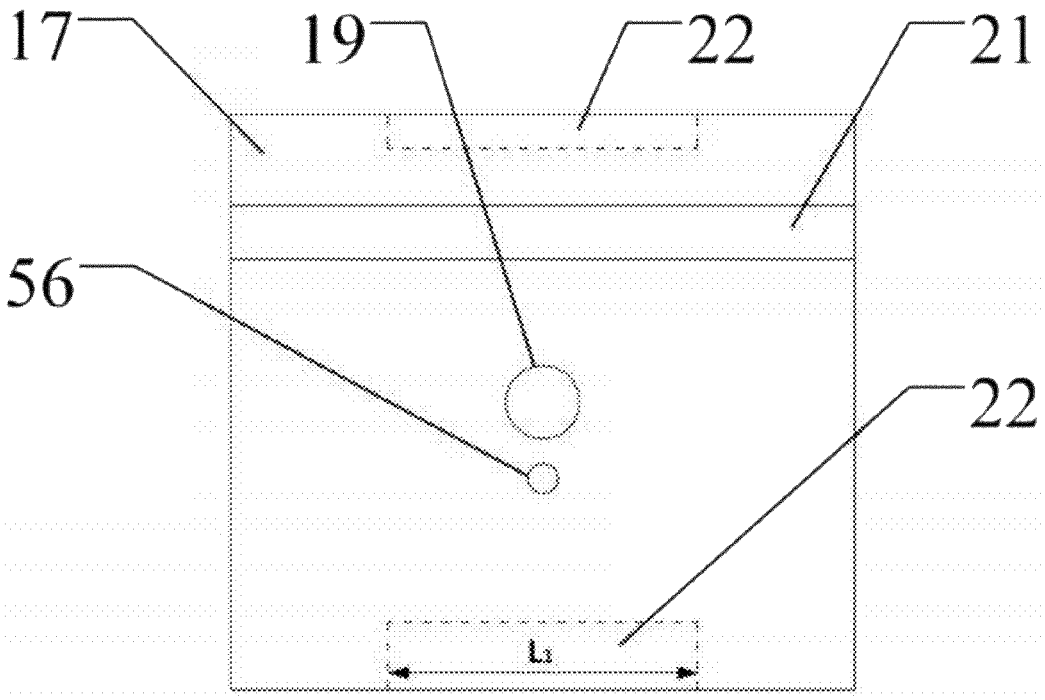
FIG. 8 is a front view of end shear resistance pallets according to the embodiments of the present invention.
Figure 9:
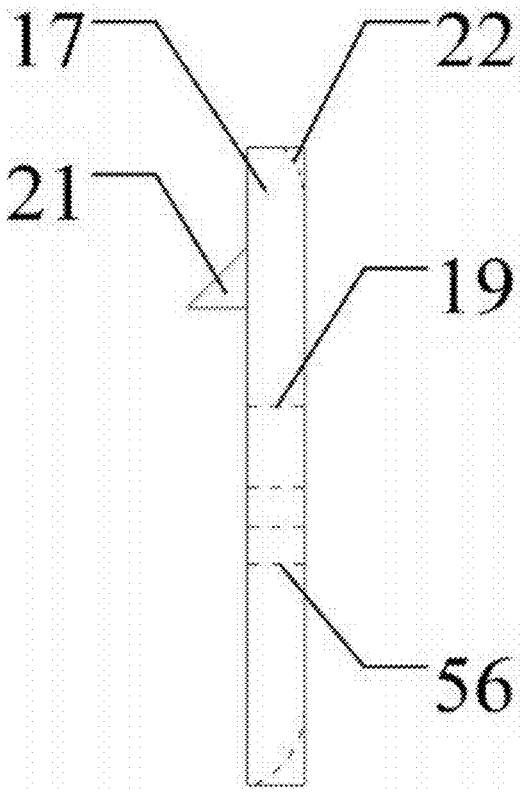
FIG. 9 is a side view of the end shear resistance pallets according to the embodiments of the present invention.
Figure 10:
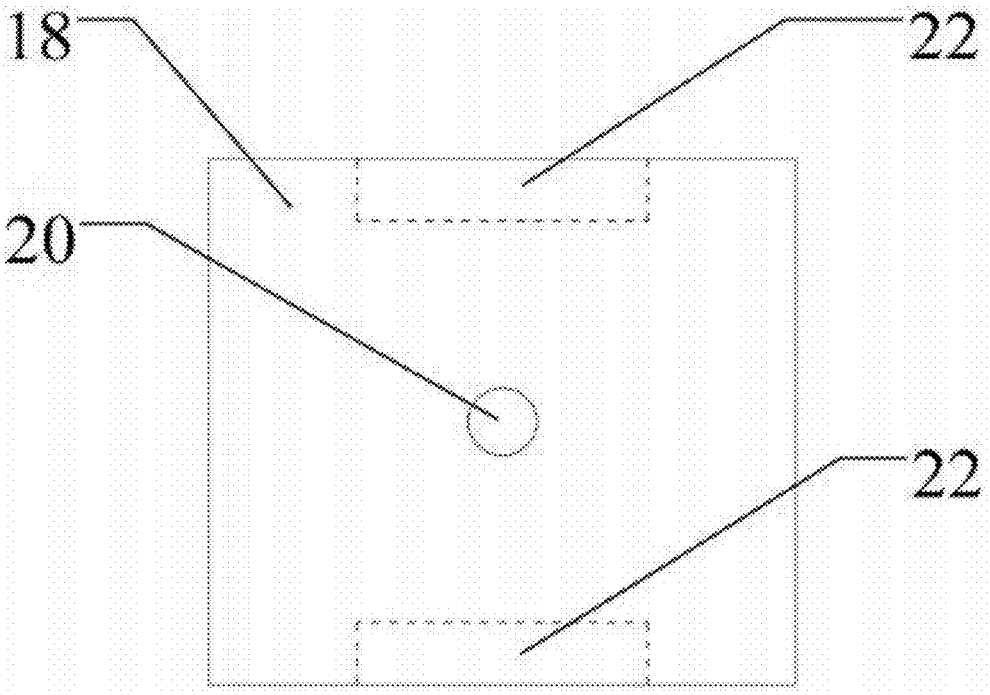
FIG. 10 is a front view of middle shear resistance pallets according to the embodiments of the present invention.
Figure 11:
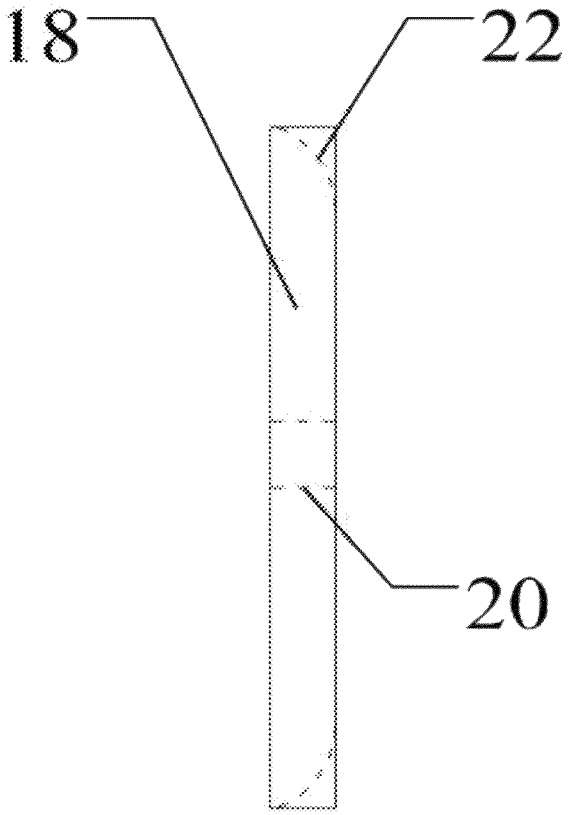
FIG. 11 is a side view of middle shear resistance pallets according to the embodiments of the present invention.
Figure 12:
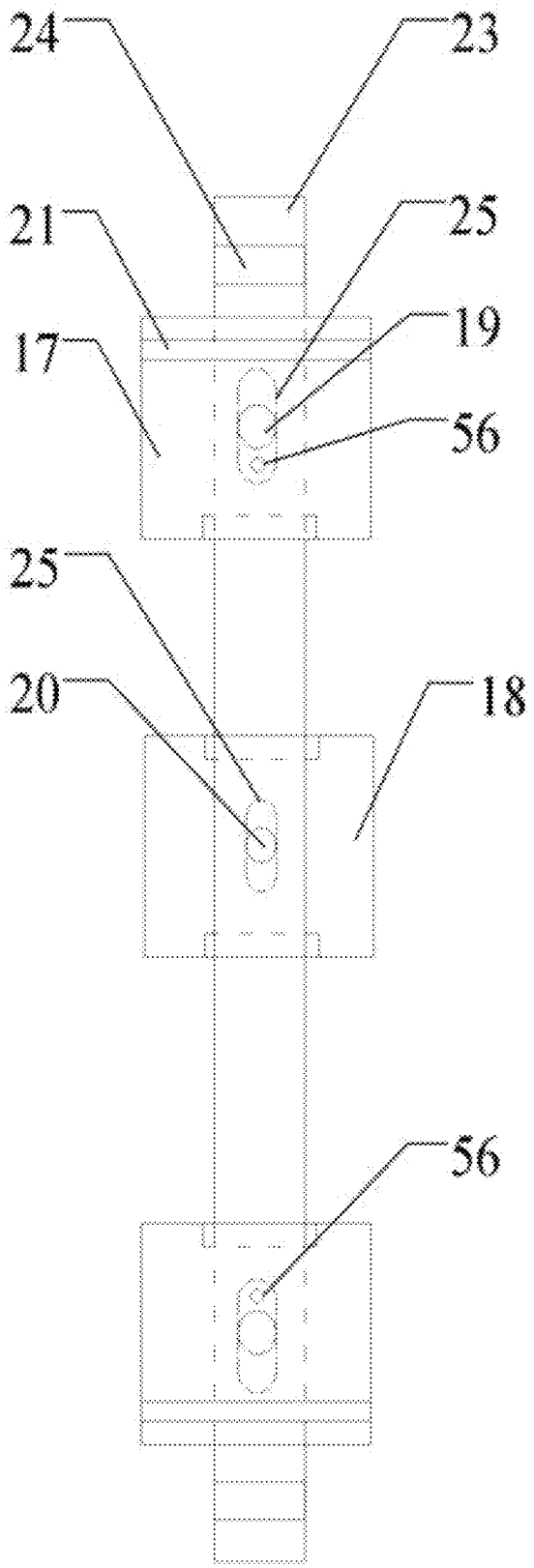
FIG. 12 is a schematic diagram of installation of pallet steel strips according to the embodiments of the present invention.
Figure 13:
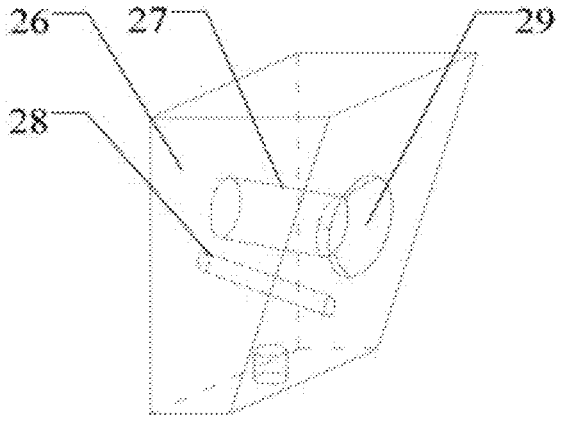
FIG. 13 is a schematic structural diagram of a of bolt-connected transfer pallets according to the embodiments of the present invention.
Figure 14:
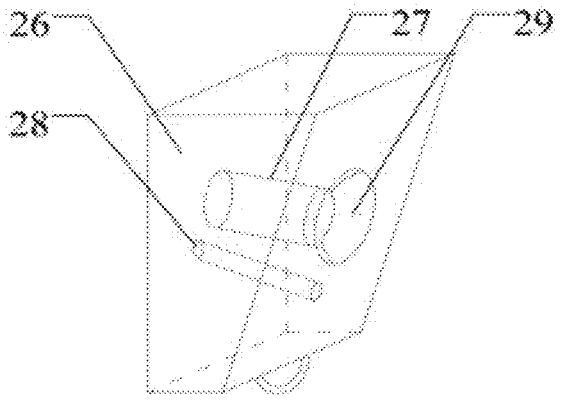
FIG. 14 is a schematic structural diagram of hook-connected transfer pallets according to the embodiments of the present invention.

As shown in FIGS. 6, 7 and 12, steel strip limit blocks 24 are arranged at ends of the shear resistance steel strips 23 to ensure that after edges of the end shear resistance pallets 17 contact the steel strip limit blocks 24, edges of the anchor cable holes of the shear resistance pallets cannot contact ends of the long anchor cable holes 25 on the shear resistance steel strips 23. In this way, the anchor cables 4 are not affected by shearing of the long anchor cable holes 25 on the shear resistance steel strips 23, and the long anchor cable holes 25 on the shear resistance steel strips 23 are also not affected by tearing of the anchor cables 4. As shown in FIGS. 8 and 9, transition zones between lower bottom surfaces and side surfaces of the end shear resistance pallets 17 are arc shear resistance zones 22; widths $L_1$ of the arc shear resistance zones 22 are slightly larger than widths of the shear resistance steel strips 23, so as to avoid the shear resistance steel strips 23 being sheared at the edges of shear pallets and significantly weakening the supporting performance of the shear steel strips 23; end anchor holes 19 are provided on the end shear resistance pallets 17 and conduit channels 56 for the conduits 11 or the filling conduits 55 to pass through; middle anchor holes 20 are provided on the middle shear resistance pallets 18; pallet limit blocks 21 are provided with upper bottom surfaces of end shear resistance pallets 17, and the pallet limit blocks 21 are used to cooperate with the transfer pallets 26 to transmit the interaction forces. As shown in FIGS. 10 and 11, lower bottom and side surfaces of the middle shear resistance pallets 18 are arc shear resistance zones 22, which prevents edges of the middle shear resistance pallets 18 from shearing the shear resistance steel strips 23 and significantly weakening support performance of the steel strips; widths $L_1$ of the arc shear resistance zones 22 are slightly larger than widths of the shear resistance steel strips 23. Circular anchor holes 27 and conduit holes 28 are provided on the transfer pallets 26, and coupling spherical recesses 29 coupled with the anchors 5 are provided on upper bottom surfaces of the transfer pallets 26; lower bottom surfaces of the transfer pallets 26 contact upper bottom surfaces of the end shear resistance pallets 17 to transmit interaction forces; As shown in FIG. 13 and FIG. 14, high side surfaces of the transfer pallets 26 contact the pallet limit blocks 21 of the end shear resistance pallets 17 to transmit interaction forces; nut holes or hanging rings that are docked with the end compensating pull rods 32 are provided on lower side surfaces of the transfer pallets 26; acute angles $\psi$ formed by the lower bottom surfaces and the upper bottom surfaces of the transfer pallets 26 are equal to or nearly equal to upper elevation angles or downward inclination angles of the anchor cables 4; interconnections between pull rods are realized by the two-way locking nuts 31, and tension states of the compensating pull rod structures 52 are actively adjusted, so that shear conditions of the anchor cables 4 outside the tunnel 3 surrounding rocks are further regulated; the conduit channels 56, the conduit holes 28 and the long anchor cable holes 25 on the shear resistance steel strips 23 are aligned during installation, which is convenient for the conduits 11 or the filling conduits 55 to pass through.

Monitored forces $F_L$: the dynamometers 58 are provided on the compensating pull rod structures 52 for monitoring pulling forces of the compensating pull rod structures 52, and the forces are assumed to be $F_L$; the forces $F_L$ are used to balance a portion of the component forces of the obliquely arranged anchor cables 4 along the tunnel walls 9 (parallel to the tunnel walls 9).

Monitored forces $F_M$: the pressure gauges 59 are installed between the end shear resistance pallets 17 and the transfer pallets 26 to monitor supporting extrusion pressures of the anchor cables 4 vertically on the tunnel walls 9, and the forces are assumed to be $F_M$;

Monitored forces $F_G$: extrusion gauges 60 are installed at contact surfaces between the steel strip limit blocks 24 and the end resistance shear pallets 17 for monitoring forces transmitted by the anchor cables 4 obliquely arranged along the tunnel walls 9 to the shear resistance steel strips 23 along the tunnel walls 9, and the forces are assumed to be $F_G$; the forces $F_G$ can prevent the anchor cable 4 bodies from tearing the long anchor cable holes 25 on the shear resistance steel strips 23 and preventing the anchor cable 4 bodies from being sheared by the long anchor cable holes 25 on the shear resistance steel strips 23; and Friction resistances $f_c$: friction resistances between the end shear resistance pallets 17 and the shear resistance steel strips 23 and the surrounding rocks are $f_c$; and $f_c$ can also balance a portion of the component forces of the anchor cables 4 obliquely arranged along the tunnel walls 9 of the tunnel 3.

The anchor cables 4 bodies in the orifices of the anchor cable drilling holes 2 are subjected to complex forces and are easily broken and failed due to influence of combined tensile and shear stresses. Therefore, it is necessary to prevent the anchor cables 4 from strongly squeezing the surrounding rocks of the orifices of the anchor cable drilling holes 2, and at the same time prevent the anchor cables 4 bodies and the shear resistance steel strips 23 from strongly squeezing and shearing each other, and also prevent the anchor cables 4 from being subjected to excessive eccentric loads due to uneven force transmissions of the anchor cables 4 and the anchors 5, which reduces the support effects. This requires the compensating pull rod structures 52 to balance the external shear resistance system of the surrounding rocks of the tunnel 3 to play a key active role.

(1) When $$F_L = \frac{\sin\psi \times F_M}{\cos\psi},$$

the compensating pull rod structures 52 completely bear the forces component of the anchor cables 4 obliquely arranged along the tunnel walls 9; in this case, the anchor cables 4 are in relatively good stress conditions and are not affected by the shear;

(2) When $$F_L = \frac{\sin\psi \times F_M}{\cos\psi}$$

and $F_G$=0, namely $$\frac{\sin\psi \times F_M}{\cos\psi} = (F_L + f_C),$$

pulling forces $F_L$ of the compensating pull rod structures 52, and friction resistances $f_c$ between the end shear resistance pallets 17 and the shear resistance steel strips 23 and the tunnel walls 9 completely bear the forces component of the anchor cables 4 obliquely arranged along the tunnel walls 9; in this case, the anchor cables 4 are in relatively good stress conditions and are basically not affected by the shear;

(3) When $$F_L < \frac{\sin\psi \times F_M}{\cos\psi}$$

and $F_G$>0, namely $$\frac{\sin\psi \times F_M}{\cos\psi} = (F_L + f_C + F_G),$$

pulling forces $F_L$ of the compensating pull rod structures 52, friction resistances $f_c$ and the forces $F_G$ of the shear resistance steel strips 23 along the tunnel walls 9 jointly bear the forces component of the anchor cables 4 obliquely arranged along the tunnel walls 9; in this case, to prevent $F_G$ from being too large, the forces Fi are actively adjusted and increased by the compensating pull rod structures 52, thereby reducing $F_G$; the forces $F_L$ is used to balance the forces component of the anchor cables 4 obliquely arranged along the tunnel walls 9 to prevent the shear resistance steel strips 23 from being damaged due to excessive tensions; and it is best to adjust the forces $F_G$ to smaller values or zero.

Figure 17:
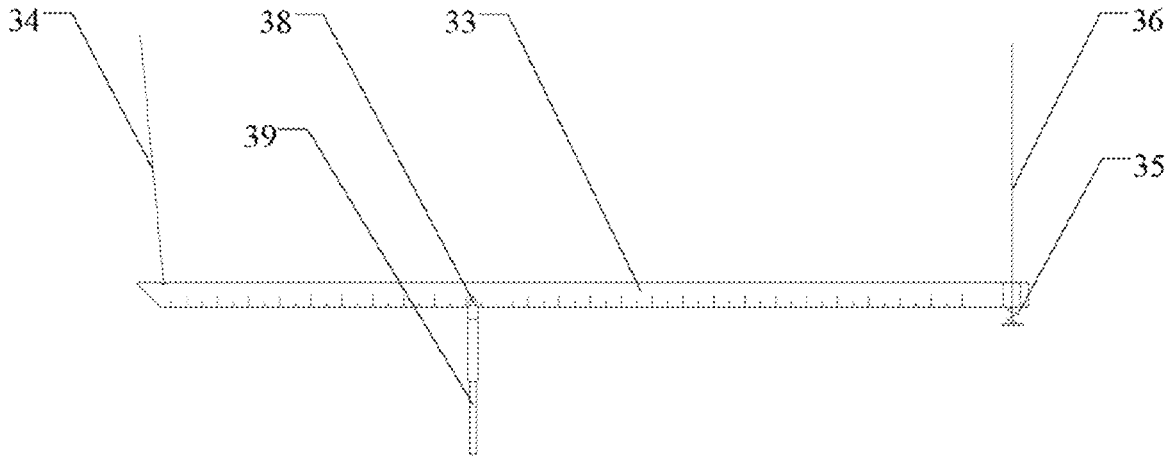
FIG. 17 is a schematic structural diagram of a monitoring system for relative shearing displacement of tunnel walls, roof and the floor layers according to the embodiments of the present invention.
Figure 18:
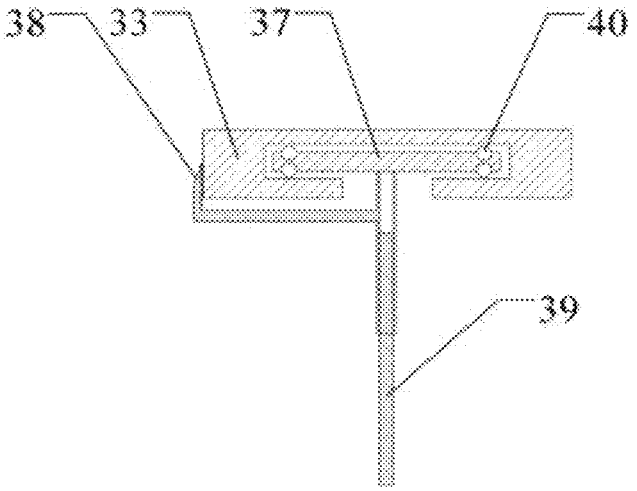
FIG. 18 is a side view of the shear misalignment measuring ruler rods according to the embodiments of the present invention.

As shown in FIGS. 17 and 18, the relative shear displacement monitoring system of the tunnel walls 9 and the roof and floor layers comprises a relative shear displacement monitoring system of the tunnel walls 9 and roof layers and a relative shear displacement monitoring system of the tunnel walls 9 and floor layers; the relative shear displacement monitoring system of the tunnel walls 9 and roof layers comprises embedded positioning anchor bolts 34, pressure-releasing anchor bolts 36 with pressure-releasing springs 35, shear misalignment measuring ruler rods 33, slide rods 37, indicator needle 38, and telescopic reference rods 39; inner slide grooves are provided in the shear misalignment measuring ruler rods; the slide rods 37 are arranged in the inner slide grooves; the indicator needles 38 and the telescopic reference rods 39 are fixedly arranged on the slide rods 37 and slide synchronously with the slide rods 37; four balls 40 are arranged on upper and lower sides of both ends of the slide rods 37 to facilitate movements of the slide rods 37; the shear misalignment measuring ruler rods 33 are attached to surfaces of the roof rock layer 6 of the tunnel 3, and axes of the shear misalignment measuring ruler rods 33 are arranged perpendicular to the tunnel walls 9; ends of the shear misalignment measuring ruler rods 33 close to the tunnel walls 9 are fixed to the roof rock layers 6 of the tunnel 3 by the embedded positioning anchors 34, and the other ends of the shear misalignment measuring ruler rods 33 are fixed to the roof rock layers 6 of the tunnel 3 by the pressure-releasing anchor bolts 36 with the pressure-releasing springs 35; and the pressure-releasing springs 35 enable the shear misalignment measuring ruler rods 33 to have a certain ability to adapt to deformations of the roof layers of the tunnel 3.

The relative shear displacement monitoring system of the tunnel walls 9 and floor layers and the relative shear displacement monitoring system of the tunnel walls 9 and top layers have the same structure and the main difference is installation positions. The shear misalignment measuring ruler rods 33 are attached to surfaces of the floor rock layer 7 of the tunnel 3, and axes of the shear misalignment measuring ruler rods 33 are arranged perpendicular to the tunnel walls 9; ends of the shear misalignment measuring ruler rods 33 close to the coal walls are fixed to the floor rock layers 7 of the tunnel 3 by the embedded positioning anchors 34, and the other ends of the shear misalignment measuring ruler rods 33 are fixed to the floor rock layers 6 of the tunnel 3 by the pressure-releasing anchor bolts 36 with the pressure-releasing springs 35; and the pressure-releasing springs 35 enable the shear misalignment measuring ruler rods 33 to have a certain ability to adapt to deformations of the floor layers of the tunnel 3.

Figure 19:
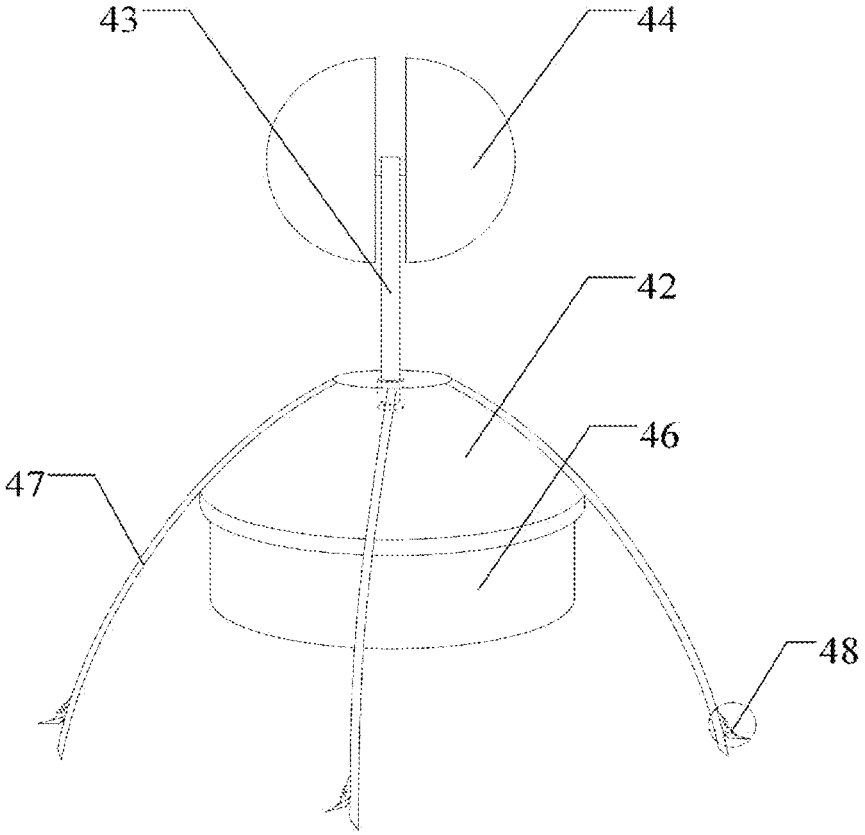
FIG. 19 is a schematic structural diagram of an anchoring agent installation system according to the embodiments of the present invention.
Figure 20:
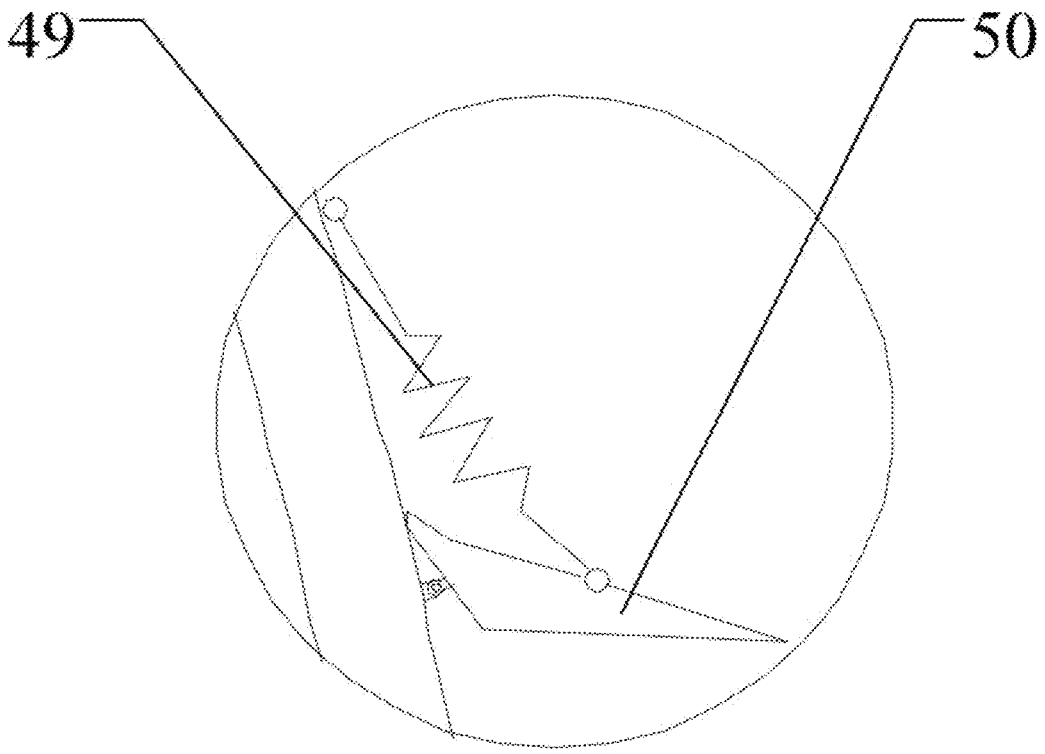
FIG. 20 is a schematic structural diagram of one-way elastic clamping wings according to the embodiments of the present invention.
Figure 21:
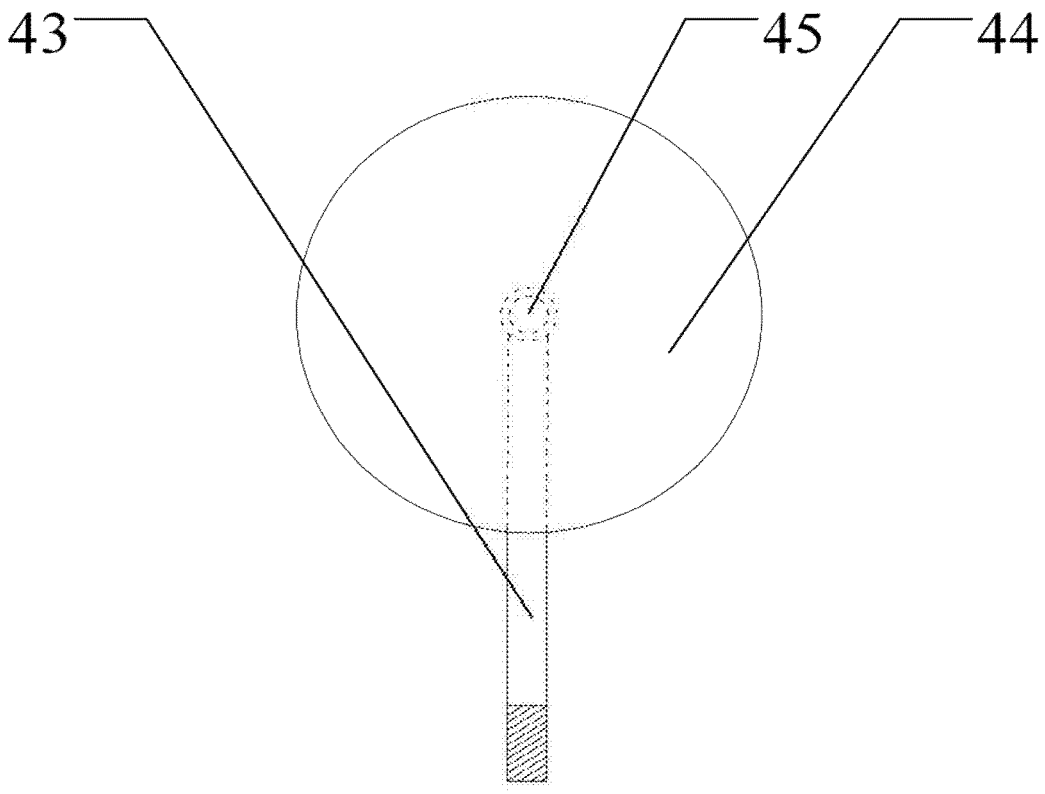
FIG. 21 is a side view of guide double half balls according to the embodiments of the present invention.
Figure 22:
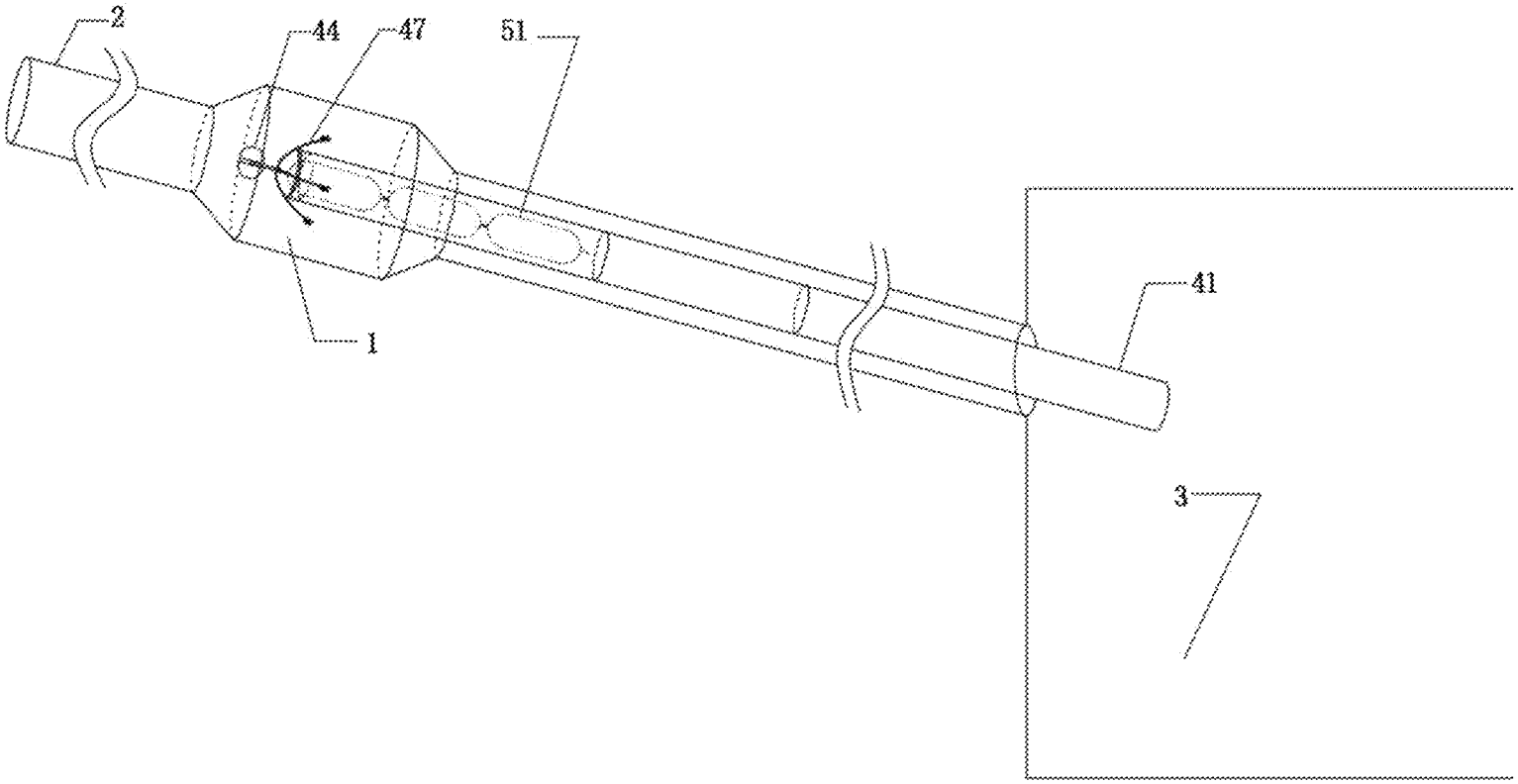
FIG. 22 is a schematic diagram of installation process of anchoring agents according to the embodiments of the present invention.

As shown in FIG. 19, the anchor agent 51 installation system comprises a guide system and push protection tubes 41, and the guide system comprises guide clamping covers 42, guide rods 43, and guide double half balls 44; clamping tubes 46 are disposed inside the guide clamping covers 42, and the clamping tubes 46 are embeddedly connected with the push protection tubes 41, so that the clamping tubes 46 can be separated smoothly when the push protection tubes 41 are withdrawn; as shown in FIG. 20, cover surfaces of the guide clamping covers 42 are arc surfaces, and a plurality of centering wings 47 are arranged on the cover surfaces; unidirectional elastic clamping wings 48 are arranged at ends of the centering wings 47; the unidirectional elastic clamping wings 48 are composed of telescopic springs 49 and clamping needles 50; the clamping needles 50 are hingedly connected to the centering wings 47. and are provided reset forces by the telescopic springs 49; as shown in FIG. 21, the guide double half balls 44 are connected to the guide rods 43 through rotating shafts 45, and the guide rods 43 are bolted to end portions of the guide covers 42; as shown in FIG. 22, the anchors 51 are connected in series to inner sides of the guide clamping covers 42 and pushed into insides of the push protection tubes 41; during the pushing process, when passing the shear misalignment tolerance cavities 1, the guide double half balls 44 are needed for the push protection tubes 41 together with the anchors 51 reaching bottom portions of the anchor cable drilling holes 2 smoothly without being stuck; the push protection tubes 41 push the guide clamping covers 42 into the anchor cable drilling holes 2; after a whole set of equipment is installed at bottom portions of the holes, the push protection tubes 41 are withdrawn, and the clamping needles 50 arranged at the end portions of the centering wings 47 will constrain the guide clamping covers 42 and the anchors 51 to remain at the bottom portions of the anchor cable drilling holes 2, thereby realizing installations of the anchors 51.

Figure 2:
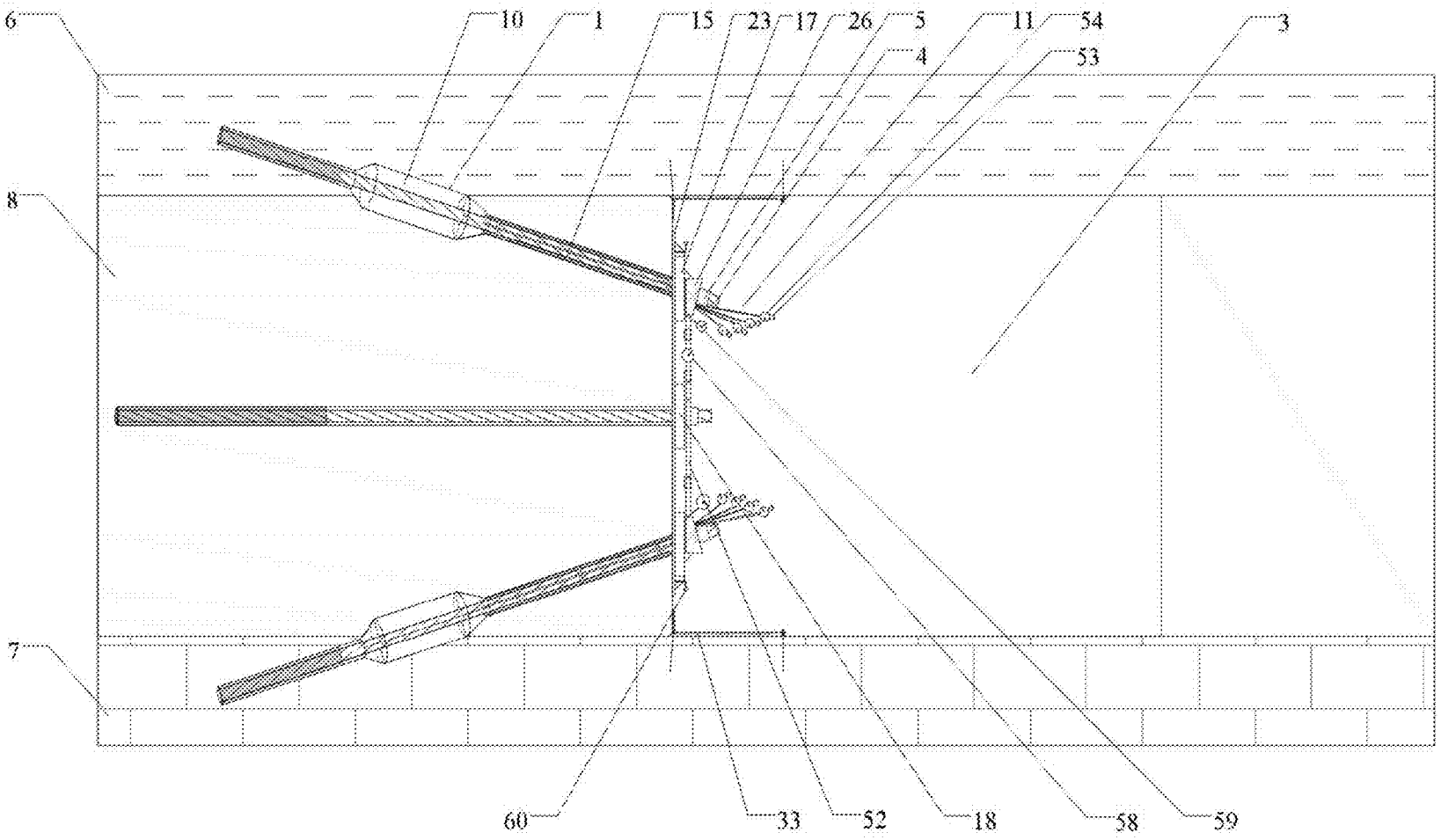
FIG. 2 is an implementation schematic diagram of a first monitoring method according to the embodiments of the present invention.
Figure 3:
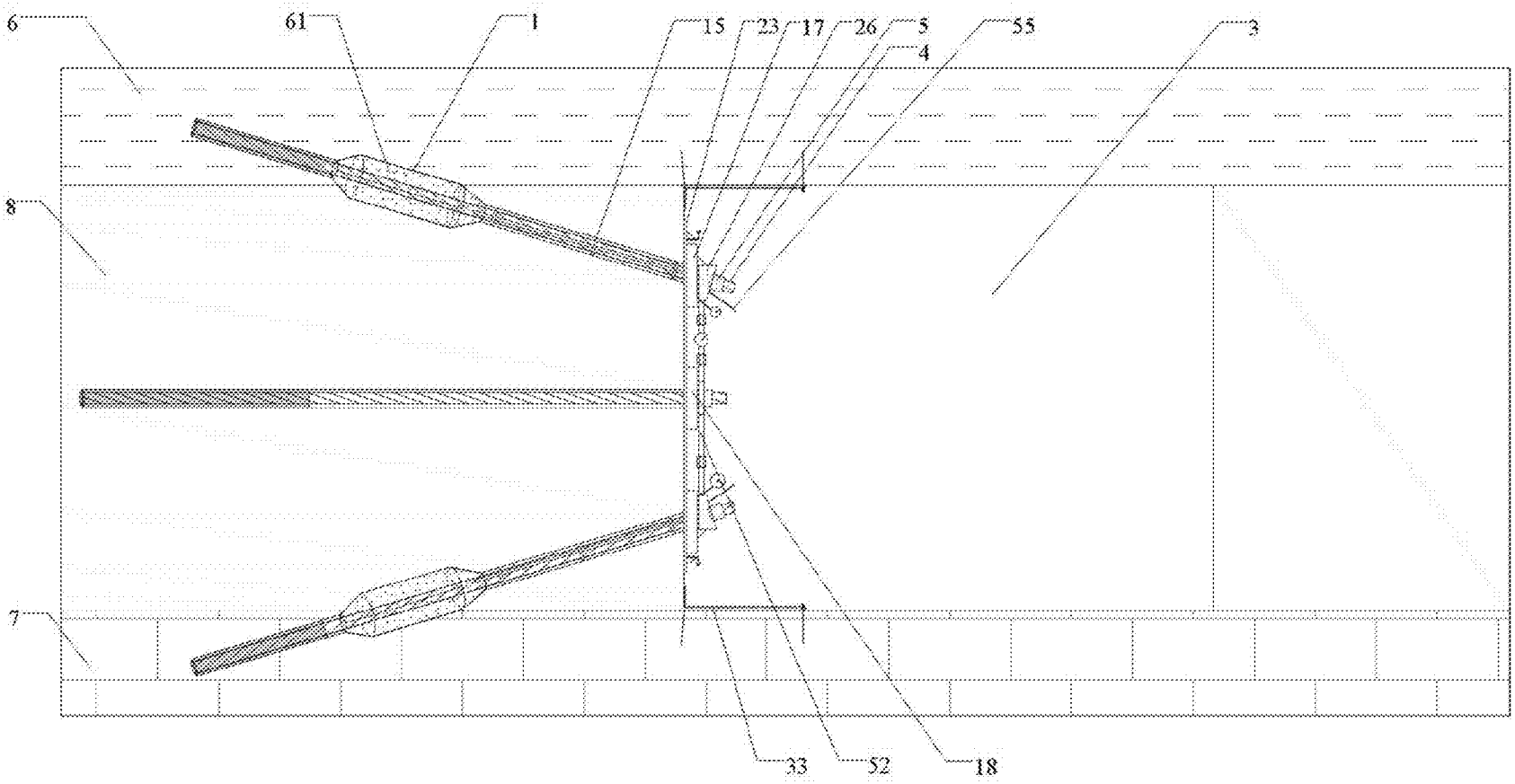
FIG. 3 is an implementation schematic diagram of a second monitoring method according to the embodiments of the present invention.

An internal and external coupling shear resistance locking monitoring method of tunnel 3 surrounding rocks in the present invention, comprising a first monitoring method using the shear misalignment extrusion partition measuring bags 10 and a second monitoring method using compressible elastic expansion materials 61; and as shown in FIG. 2, the first monitoring method comprises following steps:

Step 1: Carrying out the anchor cable drilling holes 2 in middle portions of the tunnel 3 according to conventional methods and installing the anchor cables 4 into the anchor cable drilling holes 2.

Step 2: Carrying out the anchor cable drilling holes 2 on upper sides of the tunnel walls to designed depths; upward inclination angles of the anchor cable drilling holes 2 on upper sides of the tunnel walls should be 10-30 degrees and the anchor cable drilling holes 2 should pass through the coal-rock interface areas between the walls and the roof layers not less than 3 m; then using high-pressure hydraulic jet expansion or mechanical expansion equipment to expand the anchor cable drilling holes 2 in the transition zones between the coal seams of the tunnel walls and the floor rock layers to form the shear misalignment tolerance cavities 1; diameters of the shear misalignment tolerance cavities 1 should be 10-20 cm, and lengths of the shear misalignment tolerance cavities 1 should be 10-50 cm; and both ends of the shear misalignment tolerance cavities gradually narrows outwards.

Step 3: Through the anchoring agent installation system, connecting the anchoring agents 51 in series to the inner sides of the guide clamping covers 42; setting the clamping tubes 46 and anchoring agents 51 inside the push protection tubes 41; then installing the guide rods 43 and the guide double half balls 44; pushing the anchoring agents 51 and the guide system to bottom portions of the anchor cable drilling holes 2 through the push protection tubes 41, and then withdrawing the push protection tubes 41.

Step 4: Before installing the anchor cables when carrying out the anchor cable drilling holes on the upper sides of the tunnel walls, fixing the shear misalignment extrusion partition measuring bags 10 on the anchor cables 4 according to the designed lengths; fixing the conduits 11 with elastic fixing belts 15; and after installing the anchor cables 4 to the bottom portions of the anchor cable drilling holes 2, the shear misalignment extrusion partition measuring bags 10 should be located in the shear misalignment tolerance cavities 1.

Step 5: Carrying out the anchor cable drilling holes 2 on lower sides of the tunnel walls to the coal-rock interface areas; using the high-pressure hydraulic jet expansion or mechanical expansion equipment to expand the anchor cable drilling holes 2 in the transition zones between the coal seams of the tunnel walls and the floor rock layers to form the shear misalignment tolerance cavities 1; the diameters of the shear misalignment tolerance cavities 1 should be 10-20 cm, and the lengths of the shear misalignment tolerance cavities 1 should be 10-50 cm; and both ends of the shear misalignment tolerance cavities gradually narrows outwards; downward inclination angles of the anchor cables 4 on lower sides of the tunnel walls should be 10-30 degrees; then carrying out the anchor cable drilling holes 2 to the designed depths; and the anchor cable drilling holes 2 should pass through the coal-rock interface areas between the coal walls and the floor layers not less than 3 m.

Step 6: Installing the anchoring agents 51 according to Step 3.

Step 7: Installing the shear misalignment extrusion partition measuring bags 10 and the anchor cables 4 according to Step 4.

Step 8: Installing the shear resistance steel strips 23, the extrusion gauges 60, the middle shear resistant pallets 18, the end shear resistance pallets 17, the pressure gauges 59, the transfer pallets 26, the anchors 5, the compensating pull rod structures 52, the dynamometers 58, the pressure gauges 54 and the adjustable resistance flowmeters 53 in sequence.

Step 9: After tightening the compensating pull rods through the two-way locking nuts 31 to make exposed anchor cable 4 bodies parallel to axes of the anchor cable drilling holes 2, applying preload forces to the anchor cables 4 to designed values.

Step 10, Filling the shear misalignment extrusion partition measuring bags 10 with liquid; and after being filled with liquid, the shear misalignment extrusion partition measuring bags 10 can fill the shear misalignment tolerance cavities 1.

Step 11: Installing the monitoring system for the shear displacement between the tunnel walls 9 and the top layers and the monitoring system for the shear displacement between the tunnel walls and the floor layers respectively at the intersections of the tunnel walls and the top and floor rock layers of the tunnel 3.

Step 12: Monitoring pressure values of the shear misalignment extrusion partition measuring bags 10 and liquid discharge volumes, and determining shear and extrusion deformations of the shear misalignment tolerance cavities 1 inside the surrounding rocks; monitoring changes in values of the pressure gauges of the anchor cables 4, changes in values of the dynamometers of the compensating pull rods 58, changes in numerical values of the extrusion gauges 59 of the steel strip limit blocks 24, analyzing shear conditions of the anchor cables 4 inside the surrounding rocks, and comparing relationship between values of $$\frac{\sin\psi \times F_M}{\cos\psi}$$

and ($F_L$+$F_G$); when the forces $F_G$ are too large, it is necessary to tighten the two-way locking nuts 31 to increase the compensating pulling forces Fz of the compensating pull rod structure 52, thereby reducing $F_G$ to reduce burdens on the shear resistance steel strips 23, avoid the anchor cables 4 being affected by shearing of the shear resistance steel strips 23, and avoid the anchor cables 4 being affected by squeezing and shearing of the surrounding rocks at the orifices of the anchor cable drilling holes 2.

As shown in FIG. 2, the second monitoring method comprises following steps:

It is not necessary to install the shear misalignment extrusion partition measuring bags 10 in all of the shear misalignment tolerance cavities 1 of the entire tunnel 3, so when geological conditions do not change much, it is advisable to install a group of the shear misalignment extrusion partition measuring bags 10 for every 10 to 20 rows of the anchor cables 4, so as to evaluate the deformations of the shear misalignment tolerance cavities 1 in the areas; when the geological conditions change greatly, it is advisable to install a group of the shear misalignment extrusion partition measuring bags 10 for every 5 to 10 rows of the anchor cables 4, so as to evaluate the deformations of the shear misalignment tolerance cavities 1 in the areas.

Step 1: Same as Step 1 of the implementation method;

Step 2: Same as Step 2 of the implementation method;

Step 3: Same as Step 3 of the implementation method;

Step 4: Before installing the anchor cables 4, the filling conduits 55 are fixed to the anchor cable 4 bodies through the elastic fixing belts 15; the outlets of the filling conduits 55 are in the shear misalignment tolerance cavities 1; after the anchor cables 4 are installed, the compressible elastic expansion materials 61 are filled into the shear misalignment tolerance cavities 1 through the filling conduits 55 to fill the entire shear misalignment tolerance cavities 1;

Step 5: Same as Step 5 of the implementation method;

Step 7: Installing the anchor cables 4 in the anchor cable drilling holes 2 and fill in the compressible elastic expansion materials 61 according to Step 4;

Step 8: Same as Step 1 of the implementation method;

Step 9: Same as Step 2 of the implementation method;

Step 10: Same as Step 3 of the implementation method;

Step 11: The same as step 12 of the implementation method; but there is no need to monitor pressure values and liquid discharge situation of the shear misalignment extrusion partition measuring bags 10.

Embodiment 2

The Embodiment 2 is almost the same as Embodiment 1; the difference is that the method of the present invention is used with internal pressure relief of the tunnel walls 9, that is, a set of internal pressure relief cavities is implemented inside the tunnel walls 9, 3 to 10 meters away from bottom portions of the anchor cable holes 4; as a part of external anchors of the tunnel 3, the method of the present invention forms a coupling control system of external anchoring and internal pressure relief of the tunnel walls for controlling the deformations of the surrounding rocks.

Therefore, the present invention adopts the above-mentioned internal and external coupling shear resistance locking control system and the monitoring method of tunnel 3 surrounding rocks, which solves the problem of easy breakage and failure of the anchor cables 4 when the anchor cables 4 are arranged obliquely on the tunnel walls 9 inside and outside the surrounding rocks, and realizes internal and external coupling shear resistance locking control and monitoring of the tunnel 3 surrounding rocks, which has very broad and important promotion and application value.

Finally, it should be noted that the above embodiments are only used to illustrate the technical solutions of the present invention rather than to limit them. Although the present invention has been described in detail with reference to the preferred embodiments, those skilled in the art should understand that they can still modify or replace the technical solutions of the present invention with equivalents, and these modifications or equivalent replacements cannot cause the modified technical solutions to deviate from the spirit and scope of the technical solutions of the present invention.

The invention claimed is:

1. An internal and external coupling shear resistance locking control system of tunnel surrounding rocks, the internal and external coupling shear resistance locking control system comprising:

an internal shear resistance and monitoring system of tunnel surrounding rocks, an external shear resistance and monitoring system of tunnel surrounding rocks, a relative shear displacement monitoring system of tunnel walls and roof and floor layers, and an anchor agent installation system;

wherein the internal shear resistance and monitoring system of tunnel surrounding rocks comprises a plurality of rows of shear misalignment tolerance cavities obliquely passing through transition zones between coal seams of the tunnel walls and roof rock layers or floor rock layers; both ends of the shear misalignment tolerance cavities are connected to anchor cable drilling holes; orifices of the anchor cable drilling holes are set at the tunnel walls; the shear misalignment tolerance cavities are installed with a shear misalignment partition monitoring system or filled with compressible elastic expansion materials;

the internal shear resistance and monitoring system of tunnel surrounding rocks further comprises an elastic expansion material filling system for filling compressible elastic expansion materials; the elastic expansion material filling system comprises filling conduits for conveying the compressible elastic expansion materials; outlets of the filling conduits are located in the shear misalignment tolerance cavities; inlets of the filling conduits extend out of the anchor cable drilling holes and are located in the tunnel; and the filling conduits are connected to the anchor cables in the anchor cable drilling holes through elastic fixing belts;

the shear misalignment partition monitoring system comprises shear misalignment extrusion partition measuring bags; the shear misalignment extrusion partition measuring bags are arranged in the shear misalignment tolerance cavities; the shear misalignment extrusion partition measuring bags comprise four symmetrical cavities and anchor channel holes for passing the anchor cables; constraint positioning belts are arranged at the anchor channel holes; each of the four symmetrical cavities is connected to independent conduits; inlets of the independent conduits extend out of the anchor cable drilling holes and are located in the tunnel; the independent conduits are connected to the anchor cables in the anchor cable drilling holes through elastic fixing belts; slots are arranged on the elastic fixing belts; the independent conduits are clamped in the slots; and at least one pressure gauge and at least one adjustable resistance flowmeter are arranged at the inlet of each of the independent conduits;

the external shear resistance and monitoring system of tunnel surrounding rocks comprises shear resistance pallet structures, shear resistance steel strips, compensating pull rod structures, dynamometers, pressure gauges, and extrusion gauges; the shear resistance pallet structures are arranged at the orifices of the anchor cable drilling holes; and the shear resistance pallet structures are connected to the tunnel walls through the shear resistance steel strips, and the shear resistance pallet structures are connected to the compensating pull rod structures;

middle parts of the shear resistance steel strips are provided with anchor holes, the shear resistance pallet structures comprise end shear resistant pallets, middle shear resistant pallets and transfer pallets; steel strip limit blocks are provided on both upper and lower parts of the shear resistance steel strips; end anchor holes and conduit channels for the independent conduits or the filling conduits to pass through are provided on the end shear resistant pallets; middle anchor holes are provided on the middle shear resistant pallets; transition zones between lower bottom surfaces and side surfaces of the end shear resistant pallets and the middle shear resistant pallets are arc shear zones; and pallet limit blocks are provided on the end shear resistant pallets; the transfer pallets are arranged on the end shear resistant pallets; circular anchor holes for passage of the anchor cables and the conduit channels for passage of the conduits or the filling conduits are provided on the transfer pallets; coupling spherical recesses are provided on the circular anchor holes; and the circular anchor holes are aligned with the end anchor holes;

the compensating pull rod structures comprise middle compensating pull rods; anchor holes are provided in middle portions of the middle compensating pull rods; the anchor holes are aligned with middle anchor cable holes; both ends of the middle compensating pull rods are connected to end compensating pull rods through two-way locking nuts; the end compensating pull rods are connected to the transfer pallets through threads or hooks; the dynamometers for monitoring tensions of the middle compensating pull rods and the end compensating pull rods are provided on the compensating pull rod structures; the pressure gauges are configured for monitoring support extrusion pressures of the anchor cables vertically on the tunnel walls and are installed between the end shear resistance pallets and the transfer pallets; and the extrusion gauges are installed on contact sides of the steel strip limit blocks and the end shear resistance pallets;

the relative shear displacement monitoring system of the tunnel walls and the roof and floor layers comprises two systems with the same structure: a relative shear displacement monitoring system of the tunnel walls and roof layers and a relative shear displacement monitoring system of the tunnel walls and floor layers; the relative shear displacement monitoring system of the tunnel walls and the roof and floor layers comprises shear misalignment measuring ruler rods; the shear misalignment measuring ruler rods are set on surfaces of the roof rock layers or the floor rock layers of the tunnel; one end of each of the shear misalignment measuring ruler rods are connected to top rock layers or bottom rock layers through embedded positioning anchor bolts, and another end of each of the shear misalignment measuring ruler rods are connected to the top rock layers or the bottom rock layers through pressure-releasing anchor bolts with pressure-releasing springs; inner slide grooves are provided in the shear misalignment measuring ruler rods; slide rods are provided in the inner slide grooves; the slide rods are connected to the inner slide grooves through ball bearings; telescopic reference rods are connected to bottom end portions of the slide rods; and indicator needles are connected to the telescopic reference rods; and the anchor agent installation system comprises a guide system and push protection tubes for passing anchor agents through the shear misalignment tolerance cavities; the guide system comprises guide clamping covers; guide clamping tubes are arranged in inner sides of the guide clamping covers; the guide clamping tubes are embeddedly connected with the push protection tubes; cover surfaces of the guide clamping covers are arc surfaces; a plurality of centering wings are provided on the cover surfaces of the guide clamping covers; unidirectional elastic clamping wings are provided on ends of the centering wings; the unidirectional elastic clamping wings comprises telescopic springs and clamping needles; ends of the clamping needles are hinged to the centering wings; the clamping needles are connected to the centering wings through the telescopic springs; top ends of the guide clamping covers are connected to guide double half balls through guide rods; and the guide double half balls are rotatably connected to the guide rods through rotating shafts.

2. A monitoring method for the internal and external coupling shear resistance locking control system of tunnel surrounding rocks of claim 1, the anchor cables comprising upper anchor cables and lower anchor cables, the anchor agents comprising upper anchor agents and lower anchor agents, the guide clamping tubes comprising upper guide clamping tubes and lower guide clamping tubes, the guide clamping covers comprising upper guide clamping covers and lower guide clamping covers, the push protection tubes comprising upper push protection tubes and lower push protection tubes, the guide rods comprising upper guide rods and lower guide rods, the guide double half balls comprising upper guide double half balls and lower guide double half balls, the guide system comprising an upper guide system and a lower guide system, the method comprising a first monitoring method using the shear misalignment extrusion partition measuring bags and a second monitoring method using compressible elastic expansion materials; wherein the first monitoring method comprises the following steps:

step 1: forming anchor cable drilling holes in middle portions of the tunnel and installing the anchor cables into the anchor cable drilling holes;

step 2: forming anchor cable drilling holes on upper sides of the tunnel walls to designed depths, and using hydraulic jet expansion or mechanical expansion equipment to expand the anchor cable drilling holes formed on the upper sides of the tunnel walls in the transition zones between the coal seams of the tunnel walls and the floor rock layers to form the shear misalignment tolerance cavities; wherein both ends of the shear misalignment tolerance cavities gradually narrows outwards;

step 3: installing the upper anchor cables in the anchor cable drilling holes on the upper sides of the tunnel walls; connecting the supper anchor agents in series to inner sides of the upper guide clamping covers; setting the upper guide clamping tubes and the upper anchor agents inside the upper push protection tubes; installing the upper guide rods and the upper guide double half balls; pushing the upper anchor agents and the upper guide system to bottom portions of the anchor cable drilling holes on the upper sides of the tunnel walls through the upper push protection tubes, and then withdrawing the upper push protection tubes;

step 4: before installing the anchor cables when forming the anchor cable drilling holes on the upper sides of the tunnel walls, fixing the shear misalignment extrusion partition measuring bags on the anchor cables; fixing the guide rods with the elastic fixing belts; after installing the anchor cables to the bottom portions of the anchor cable drilling holes on the upper sides of the tunnel walls, the shear misalignment extrusion partition measuring bags are located in the shear misalignment tolerance cavities;

step 5: forming anchor cable drilling holes on lower sides of the tunnel walls to designed depths, and using hydraulic jet expansion or mechanical expansion equipment to expand the anchor cable drilling holes in the transition zones between the coal seams of the tunnel walls and the floor rock layers to form the shear misalignment tolerance cavities;

step 6: installing the lower anchor cables in the anchor cable drilling holes on the lower sides of the tunnel walls; connecting the lower anchor agents in series to inner sides of the lower guide clamping covers; setting the lower guide clamping tubes and the lower anchor agents inside the lower push protection tubes; installing the lower guide rods and the lower guide double half balls; pushing the lower anchor agents and the lower guide system to bottom portions of the anchor cable drilling holes on the lower sides of the tunnel walls through the lower push protection tubes, and then withdrawing the lower push protection tubes;

step 7: before installing the anchor cables when forming the anchor cable drilling holes on the lower sides of the tunnel walls, fixing the shear misalignment extrusion partition measuring bags on the anchor cables; fixing the guide rods with the elastic fixing belts; after installing the anchor cables to the bottom portions of the anchor cable drilling holes on the lower sides of the tunnel walls, the shear misalignment extrusion partition measuring bags are located in the shear misalignment tolerance cavities;

step 8: at the orifices of the anchor cable drilling holes on the upper walls and the anchor cable drilling holes on the lower walls, installing the shear resistance steel strips, the extrusion gauges, the middle shear resistant pallets, the end shear resistance pallets, the pressure gauges, the transfer pallets, the anchor cables, the compensating pull rod structures, the dynamometers, and the adjustable resistance flowmeters in sequence;

step 9: after tightening the compensating pull rod structures through the two-way locking nuts to make exposed anchor cable bodies parallel to axes of the anchor cable drilling holes, applying preload forces to the anchor cables to designed values;

step 10: filling the shear misalignment extrusion partition measuring bags with liquid;

step 11: installing the monitoring system for the shear displacement between the tunnel walls and the top layers at the intersections of the tunnel walls and top rock layers, and installing the monitoring system for the shear displacement between the tunnel walls and the floor layers at the intersections of the tunnel walls and the floor rock layers; and step 12: monitoring pressure values and liquid discharge volumes of the shear misalignment extrusion partition measuring bags, and determining shear and extrusion deformations of the shear misalignment tolerance cavities inside the surrounding rocks; monitoring changes in values of the pressure gauges of the anchor cables, changes in values of the dynamometers of the compensating pull rods, changes in numerical values of the extrusion gauges of the steel strip limit blocks, the shear displacement of the roof and floor layers relative to coal walls, evaluating the relative displacement of the tunnel walls and the roof rock layers and floor rock layers, and adjusting tension values of the compensating pull rods to reduce values of the extrusion gauges.

3. A monitoring method for the internal and external coupling shear resistance locking control system of tunnel surrounding rocks of claim 1, the anchor cables comprising upper anchor cables and lower anchor cables, the anchor agents comprising upper anchor agents and lower anchor agents, the guide clamping tubes comprising upper guide clamping tubes and lower guide clamping tubes, the guide clamping covers comprising upper guide clamping covers and lower guide clamping covers, the push protection tubes comprising upper push protection tubes and lower push protection tubes, the guide rods comprising upper guide rods and lower guide rods, the guide double half balls comprising upper guide double half balls and lower guide double half balls, the guide system comprising an upper guide system and a lower guide system, the monitoring method comprising the following steps:

step 1: forming anchor cable drilling holes in middle portions of the tunnel and installing the anchor cables into the anchor cable drilling holes;

step 2: forming anchor cable drilling holes on upper sides of the tunnel walls to designed depths, and using hydraulic jet expansion or mechanical expansion equipment to expand the anchor cable drilling holes formed on the upper sides of the tunnel walls in the transition zones between the coal seams of the tunnel walls and the floor rock layers to form the shear misalignment tolerance cavities; wherein both ends of the shear misalignment tolerance cavities gradually narrows outwards;

step 3: installing the upper anchor cables in the anchor cable drilling holes on the upper sides of the tunnel walls; connecting the upper anchor agents in series to inner sides of the upper guide clamping covers; setting the upper guide clamping tubes and the upper anchor agents inside the upper push protection tubes; installing the upper guide rods and the upper guide double half balls; pushing the upper anchor agents and the upper guide system to bottom portions of the anchor cable drilling holes on the upper sides of the tunnel walls through the upper push protection tubes, and then withdrawing the upper push protection tubes;

step 4: before installing the anchor cables when forming the anchor cable drilling holes on the upper sides of the tunnel walls, fixing the filling conduits to anchor cable bodies through the elastic fixing belts; wherein the outlets of the filling conduits are in the shear misalignment tolerance cavities; after installing the anchor cables, filling the compressible elastic expansion materials into the shear misalignment tolerance cavities through the filling conduits;

step 5: forming the anchor cable drilling holes on lower sides of the tunnel walls to designed depths, and using hydraulic jet expansion or mechanical expansion equipment to expand the anchor cable drilling holes in the transition zones between the coal seams of the tunnel walls and the floor rock layers to form the shear misalignment tolerance cavities;

step 6: installing the anchor cables in the anchor cable drilling holes on the lower sides of the tunnel walls; connecting the lower anchor agents in series to inner sides of the lower guide clamping covers; setting the lower guide clamping tubes and the lower anchor agents inside the lower push protection tubes; installing the lower guide rods and the lower guide double half balls; pushing the lower anchor agents and the lower guide system to bottom portions of the anchor cable drilling holes on the lower sides of the tunnel walls through the lower push protection tubes, and then withdrawing the lower push protection tubes;

step 7: before installing the anchor cables when forming the anchor cable drilling holes on the lower sides of the tunnel walls, fixing the filling conduits to the anchor cable bodies through the elastic fixing belts; wherein the outlets of the filling conduits are in the shear misalignment tolerance cavities; after installing the anchor cables, filling the compressible elastic expansion materials into the shear misalignment tolerance cavities through the filling conduits;

step 8: at-the orifices of the upper anchor cable drilling holes and the lower anchor cable drilling holes, installing the shear resistance steel strips, the extrusion gauges, the middle shear resistant pallets, the end shear resistance pallets, the pressure gauges, the transfer pallets, the anchor cables, the compensating pull rod structures, the dynamometers and the adjustable resistance flowmeters in sequence;

step 9: after tightening the compensating pull rod structures through the two-way locking nuts to make exposed anchor cable bodies parallel to axes of the anchor cable drilling holes, applying preload forces to the anchor cables to designed values;

step 10: filling the shear misalignment extrusion partition measuring bags with liquid;

step 11: monitoring changes in values of the pressure gauges of the anchor cables, changes in values of the dynamometers of the compensating pull rod structures, changes in numerical values of the extrusion gauges of the steel strip limit blocks, the shear displacement of the roof and floor layers relative to coal walls, evaluating the relative displacement of the tunnel walls and the roof and floor layers, and adjusting tension values of the compensating pull rods to reduce values of the extrusion gauges.

* * * * *